US008182740B2

(12) United States Patent
Okamoto et al.

(10) Patent No.: US 8,182,740 B2
(45) **Date of Patent: *May 22, 2012**

(54) HIGH-STRENGTH STEEL SHEETS EXCELLENT IN HOLE-EXPANDABILITY AND DUCTILITY

(75) Inventors: Riki Okamoto, Tokai (JP); Hirokazu Taniguchi, Tokai (JP); Masashi Fukuda, Tokai (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/584,903

(22) Filed: Sep. 14, 2009

(65) Prior Publication Data

US 2010/0111749 A1 May 6, 2010

Related U.S. Application Data

(62) Division of application No. 10/576,227, filed as application No. PCT/JP03/16967 on Dec. 26, 2003.

(30) Foreign Application Priority Data

Oct. 17, 2003 (JP) ..... 2003-357278
Oct. 17, 2003 (JP) ..... 2003-357279
Oct. 17, 2003 (JP) ..... 2003-357280

(51) Int. Cl.
*C22C 38/04* (2006.01)
*C22C 38/60* (2006.01)
*C22C 38/06* (2006.01)
*C22C 38/14* (2006.01)

(52) U.S. Cl. ..... 420/84; 420/87; 420/103; 420/120; 420/126

(58) Field of Classification Search ..... 420/84, 420/87, 103, 120, 126
See application file for complete search history.

(56) References Cited

U.S. PATENT DOCUMENTS 6,210,496 B1 * 4/2001 Takagi et al. ..... 148/333
6,224,689 B1 5/2001 Koo et al.
6,364,968 B1 * 4/2002 Yasuhara et al. ..... 148/320
(Continued)

FOREIGN PATENT DOCUMENTS

EP 1 143 023 10/2001
(Continued)

OTHER PUBLICATIONS

European Search Report in EP Application No. 10 15 6257 dated Apr. 29, 2010.

(Continued)

*Primary Examiner* — Jie Yang
(74) *Attorney, Agent, or Firm* — Kenyon & Kenyon LLP

(57) ABSTRACT

High-strength steel sheet excellent in hole-expandability and ductility, characterized by; comprising, in mass %, C: not less than 0.01% and not more than 0.20%, Si: not more than 1.5%, Al: not more than 1.5%, Mn: not less than 0.5% and not more than 3.5%, P: not more than 0.2%, S: not less than 0.0005% and not more than 0.009%, N: not more than 0.009%, Mg: not less than 0.0006% and not more than 0.01%, O: not more than 0.005% and Ti: not less than 0.01% and not more than 0.20% and/or Nb: not less than 0.01% and not more than 0.10%, with the balance consisting iron and unavoidable impurities, having Mn %, Mg %, S % and O % satisfying equations (1) to (3), and having the structure primarily comprising one or more of ferrite, bainite and martensite.

$$[\text{Mg }\%] \geqq ([\text{O }\%]/16\times0.8)\times24 \quad (1)$$

$$[\text{S }\%] \leqq ([\text{Mg }\%]/24-[\text{O }\%]/16\times0.8+0.00012)\times32 \quad (2)$$

$$[\text{S }\%] \leqq 0.0075/[\text{Mn }\%] \quad (3)$$

9 Claims, 5 Drawing Sheets

U.S. PATENT DOCUMENTS

2006/0231166 A1* 10/2006 Okamoto et al. ..... 148/320

FOREIGN PATENT DOCUMENTS

| | | |
|---|---|---|
| EP | 1 221 493 | 7/2002 |
| EP | 1 348 771 | 10/2003 |
| JP | 03-180426 | 8/1991 |
| JP | 04-088125 | 3/1992 |
| JP | 06-293910 | 10/1994 |
| JP | 11-286743 | 10/1999 |
| JP | 11-323488 | 11/1999 |
| JP | 2000-119797 | 4/2000 |
| JP | 2000 256784 | 9/2000 |
| JP | 2001-288531 | 10/2001 |
| JP | 2001-342543 | 12/2001 |
| JP | 2001 342543 | 12/2001 |
| JP | 2002-020838 | 1/2002 |
| JP | 2002 020838 | 1/2002 |
| JP | 2002-180188 | 6/2002 |
| JP | 2002-180189 | 6/2002 |
| JP | 2002-180190 | 6/2002 |
| JP | 2003-166035 | 6/2003 |

OTHER PUBLICATIONS

Supplementary European Search Report dated May 21, 2008 issued in corresponding European Patent Application No. 03 76 8328.

Tsutomu et al., Hot Rolling Steel Sheet with High Strength, Excellent in Boring Property and Ductility, and its Production, Dec. 14, 2001, Pub. No. 2001342543, Machine Translation via PAJ.

Tsutomu et al., Low Corrosion Rate and High Strength Hot Rolled Steel Sheet Excellent in Hole Expansibility and Ductility, and its Production Method, Jan. 23, 2002, Pub. No. 2002020838, Machine Translation via PAJ.

* cited by examiner

HIGH-STRENGTH STEEL SHEETS EXCELLENT IN HOLE-EXPANDABILITY AND DUCTILITY

This application is a divisional application under 35 U.S.C. §120 and §121 of prior application Ser. No. 10/576,227, filed Apr. 13, 2006, which is a 35 U.S.C. §371 of International Application No. PCT/JP2003/16967, filed Dec. 26, 2003, which claimed priority to Japanese Application Nos. 2003-357278, filed Oct. 17, 2003; 2003-357279, filed Oct. 17, 2003; and 2003-357280, filed Oct. 17, 2003, each of which is incorporated by reference herein in its entirety.

TECHNICAL FIELD

The present invention relates to high-strength steel sheets having thicknesses of not more than approximately 6.0 mm and tensile strengths of not less than 590 N/mm$^2$, or, in particular, not less than 980 N/mm$^2$. The steel sheets are excellent in hole-expandability and ductility and are used primarily as automotive steel sheets subject to press-forming.

BACKGROUND ART

In recent years, efforts have been made to develop hot-rolled high-strength steel sheets excellent in press formability in order to meet the increasing needs for car weight reductions as means to improve automotive fuel efficiency as well as for integral forming as a means to cut down production costs. Dual-phase steel sheets comprising ferritic and martensitic structures have, conventionally, been known as hot-rolled steel sheets for forming.

Being made up of a composite structure comprising a soft ferrite phase and a hard martensite phase, dual-phase steel sheets are inferior in hole-expandability because voids develop from the interface between the two phases of significantly different hardnesses and, therefore, they are unfit for uses that demand high hole-expandability, such as suspension members.

In comparison, Japanese Unexamined Patent Publications No. 4-88125 and No. 3-180426 propose methods for manufacturing hot-rolled steel sheets primarily comprising bainite and, thus, having excellent hole-expandability. However, the steel sheets manufactured by the proposed methods are limited in applicability because of inferior ductility.

Japanese Unexamined Patent Publications No. 6-293910, No. 2002-180188, No. 2002-180189 and No. 2002-180190 propose steel sheets comprising mixed structures of ferrite and bainite and having compatible hole-expandability and ductility. However, needs for greater car weight reduction and more complicated parts and members demand still greater hole-expandability, higher workability and greater strength than can be provided by the proposed technologies.

The inventors discovered that the condition of cracks in punched holes is important for the improvement of hole-expandability without an accompanying deterioration of ductility, as disclosed in Japanese Unexamined Patent Publications No. 2001-342543 and No. 2002-20838. That is to say, the inventors discovered that particle size refinement of (Ti, Nb)N produces fine uniform voids in the cross section of punched holes, relieves stress concentration during the time when the hole is expanded and thereby improves hole-expandability.

The discoveries included the use of Mg-oxides as a means for accomplishing the particle size refinement of (Ti, Nb)N. However, the proposed technology, which controls only oxides, does not provide adequate effect because the degree of freedom in the control of oxygen is low, the total volume of oxygen available is small because free oxygen after deoxidation is used, and, therefore, the desired degree of dispersion has been difficult to obtain.

SUMMARY OF THE INVENTION

The object of the present invention is to solve the conventional problems described above and, more specifically, to provide high-strength steel sheets having tensile strength of not less than 590 N/mm$^2$, and preferably not less than 980 N/mm$^2$, and excellent in both hole-expandability and ductility.

The inventors conducted various experiments and studies on particle size refinement of (Ti, Nb)N in order to relieve stress concentration during hole-expansion work and thereby improve hole-expandability by forming fine uniform voids in the cross sections of the punched holes.

Although it has conventionally been said that sulfides cause deterioration of hole-expandability, the experiments and studies led to a discovery that Mg-sulfides are conducive to the improvement of hole-expandability by the particle size refinement of TiN because Mg-sulfides precipitating at high temperatures act as the nucleus for forming (Ti, Nb)N precipitates and Mg-sulfides precipitating at low temperatures inhibit the growth of (Ti, Nb)N by way of competitive precipitation with (Ti, Nb)N.

It was also discovered that, in order to avoid the precipitation of manganese sulfides and achieve the above-described actions by the precipitation of Mg-sulfides, it is necessary to keep the amounts of addition of oxygen, magnesium, manganese and sulfur within certain limits which; in turn, facilitates the attainment of more uniform and finer particles (Ti, Nb)N than those obtained by the use of Mg-oxides alone. The following invention was made based on the findings described above.

(1) High-strength steel sheet excellent in hole-expandability and ductility, characterized by;

comprising, in mass %,

C: not less than 0.01% and not more than 0.20%

Si: not more than 1.5%,

Al: not more than 1.5%,

Mg: not less than 0.5% and not more than 3.5%,

P: not more than 0.2%,

S: not less than 0.0005% and not more than 0.009%,

N: not more than 0.009%,

Mg: not less than 0.0006% and not more than 0.01%,

O: not more than 0.005% and

Ti: not less than 0.01% and not more than 0.20% and/or Nb: not less than 0.01% and not more than 0.10%, with the balance consisting of iron and unavoidable impurities, having Mn %, Mg %, S % and O % satisfying equations (1) to (3), and having the structure primarily comprising one or more of ferrite, bainite and martensite.

$$[\text{Mg }\%] \geqq ([\text{O }\%]/16\times0.8)\times24 \quad (1)$$

$$[\text{S }\%] \leqq ([\text{Mg }\%]/24-[\text{O }\%]/16\times0.8+0.00012)\times32 \quad (2)$$

$$[\text{S }\%] \leqq 0.0075/[\text{Mn }\%] \quad (3)$$

(2) High-strength steel sheet excellent in hole-expandability and ductility described in item (1), characterized by containing not less than $5.0\times10^2$ per square millimeter and not more than $1.0\times10^7$ per square millimeter of composite precipitates of MgO, MgS and (Nb, Ti)N of not smaller than 0.05 μm and not larger than 3.0 μm.

(3) High-strength steel sheet excellent in hole-expandability and ductility described in item (1), characterized by having Al % and Si % satisfying equation (4).

$$[Si\ \%]+2.2\times[Al\ \%]\geqq 0.35 \quad (4)$$

(4) High-strength steel sheet excellent in hole-expandability and ductility described in item (2), characterized by having Al % and Si % satisfying equation (4).

$$[Si\ \%]+2.2\times[Al\ \%]\geqq 0.35 \quad (4)$$

(5) High-strength steel sheet excellent in hole-expandability and ductility described in any of items (1) to (4), characterized by;

having Ti %, C %, Mn % and Nb % satisfying equations (5) to (7), having the structure primarily comprising bainite, and having a strength exceeding 980 N/mm$^2$.

$$0.9\leqq 48/12\times[C\ \%]/[Ti\ \%]<1.7 \quad (5)$$

$$50227\times[C\ \%]-4479\times[Mn\ \%]>-9860 \quad (6)$$

$$811\times[C\ \%]+135\times[Mn\ \%]+602\times[Ti\ \%]+794\times[Nb\ \%]>465 \quad (7)$$

(6) High-strength steel sheet excellent in hole-expandability and ductility described in any of items (1) to (4), characterized by;

having C %, Si %, Al % and Mn % satisfying equation (8), having the structure primarily comprising ferrite and martensite, and having a strength exceeding 590 N/mm$^2$.

$$-100\leqq -300[C\ \%]+105[Si\ \%]-95[Mn\ \%]+233[Al\ \%] \quad (8)$$

(7) High-strength steel sheet excellent in hole-expandability and ductility described in item (6), characterized in that;

not less than 80% of crystal grains having a short diameter (ds) to long diameter (dl) ratio (ds/dl) of not less than 0.1 exist in the steel structure.

(8) High-strength steel sheet excellent in hole-expandability and ductility described in item (7), characterized in that;

not less than 80% of ferrite crystal grains having a diameter of not less than 2 μm exist in the steel structure.

(9) High-strength steel sheet excellent in hole-expandability and ductility described in any of items (1) to (4), characterized by;

having C %, Si %, Mn % and Al %, satisfying equation (8), having the structure primarily comprising ferrite and bainite, and having the strength exceeding 590 N/mm$^2$.

$$-100\leqq -300[C\ \%]+105[Si\ \%]-95[Mn\ \%]+233[Al\ \%] \quad (8)$$

(10) High-strength steel sheet excellent in hole-expandability and ductility described in item (9), characterized in that;

not less than 80% of crystal grains having a short diameter (ds) to long diameter (dl) ratio (ds/dl) of not less than 0.1 exist in the steel structure.

(11) High-strength steel sheet excellent in hole-expandability and ductility described in item (10), characterized in that;

not less than 80% of ferrite crystal grains having a diameter of not less than 2 μm exist in the steel structure.

(12) A method for manufacturing high-strength steel sheet excellent in hole-expandability and ductility, which has the structure primarily comprising ferrite and martensite and a strength in excess of 590 N/mm$^2$, characterized by the steps of;

completing the rolling of steel having a composition described in any of items (1) to (4) at a finish-rolling temperature of not lower than the $Ar_3$ transformation point, cooling at a rate of not less than 20° C./sec, and coiling at a temperature below 300° C.

(13) A method for manufacturing high-strength steel sheet, excellent in hole-expandability and ductility, which has the structure primarily comprising ferrite and martensite and a strength in excess of 590 N/mm$^2$ characterized by the steps of;

completing the rolling of steel having a composition described in any of items (1) to (4) at a finish-rolling temperature of not lower than the $Ar_3$ transformation point, cooling to between 650° C. and 750° C. at a rate of not less than 20° C./sec, air-cooling at said temperature for not longer than 15 seconds, re-cooling, and coiling at a temperature below 300° C.

(14) A method for manufacturing high-strength steel sheet, excellent in hole-expandability and ductility, which has the structure primarily comprising ferrite and bainite and a strength in excess of 590 N/mm$^2$; characterized by the steps of;

completing the rolling of steel having a composition described in any of items (1) to (4) at a finish-rolling temperature of not lower than the $Ar_3$ transformation point, cooling at a rate of not less than 20° C./sec, and coiling at a temperature of not lower than 300° C. and not higher than 600° C.

(15) A method for manufacturing high-strength steel sheet excellent in hole-expandability and ductility, which has the structure primarily comprising ferrite and bainite and a strength in excess of 590 N/mm$^2$; characterized by the steps of;

completing the rolling of steel having a composition described in any of items (1) to (4) at a finish-rolling temperature of not lower than the $Ar_3$ transformation point, cooling to between 650° C. and 750° C. at a rate of not less than 20° C./sec, air-cooling at said temperature for not longer than 15 seconds, re-cooling, and coiling at a temperature of not lower than 300° C. and not higher than 600° C.

THE MOST PREFERRED EMBODIMENT

Figure 1:
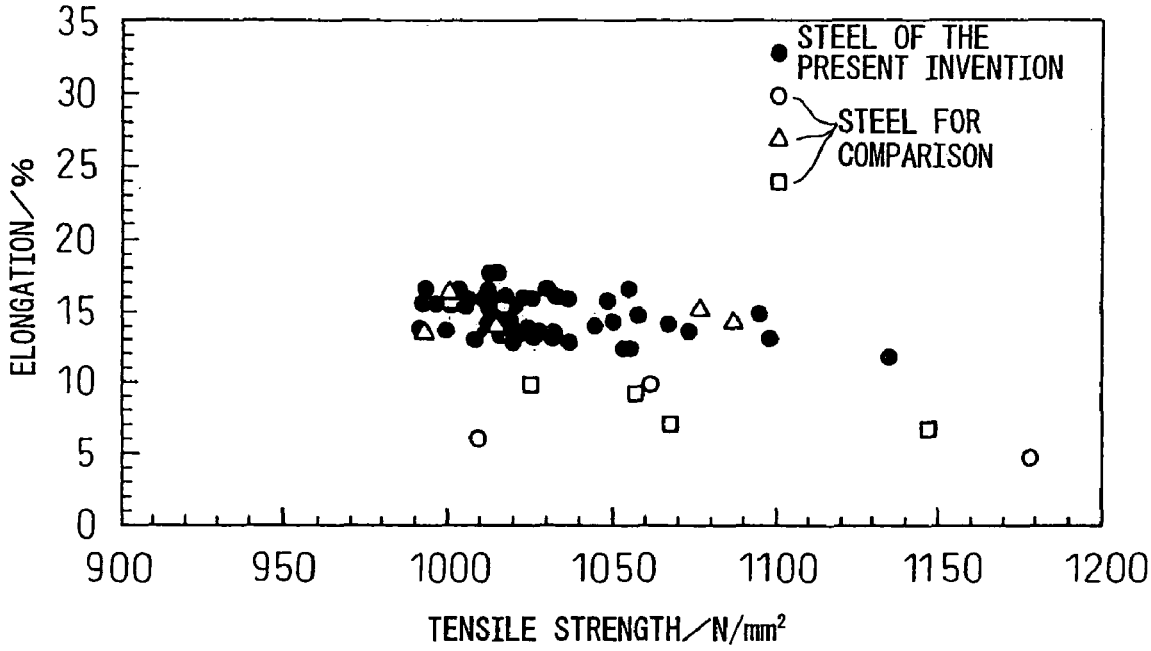
FIG. 1 shows the relationship between tensile strength and ductility.

With attention focused on the end-face properties of punched holes, the present invention improves hole-expandability by adjusting the amount of addition of O, Mg, Mn and S so that Mg-oxides and sulfides are uniformly and finely precipitated, generation of large cracks during pouching is inhibited and end-face properties of punched holes are made uniform.

Constituent features of the present invention are described below in detail.

First, the reason why the composition of the high-strength steel sheets according to the present invention should be limited will be described. In addition % means mass %.

C is an element that affects the workability of steel. Workability deteriorates as C content increases. The C content should be not more than 0.20% because carbides deleterious to hole-expandability (such as pearlite and cementite) are formed when the C content exceeds 0.20%. It is preferable that the C content is not more than 0.1% when particularly high hole-expandability is demanded. Meanwhile, the C content should be not less than 0.01% for the securing of necessary strength.

Si is an element that effectively enhances ductility by inhibiting the formation of deleterious carbides and increasing ferrite content. Si also secures strength of steel by solid-solution strengthening. It is therefore desirable to add Si. Even so, the Si content should be not more than 1.5% because excessive Si addition not only lowers chemical convertibility but also deteriorates spot weldability.

Al too, like Si, is an element that effectively enhances ductility by inhibiting the formation of deleterious carbides and increasing ferrite content. Al is particularly necessary for providing compatibility between ductility and chemical convertibility.

Al has conventionally been considered necessary for deoxidation and added in amounts between approximately 0.01% and 0.07%. Through various studies, the inventors discovered that abundant addition of Al improves chemical compatibility without deteriorating ductility even in low —Si steels.

However, the Al content should be not more than 1.5% because excessive addition not only saturates the ductility enhancing effect but also lowers chemical compatibility and deteriorates spot weldability. In particular, it is preferable to keep the Al content not more than 1.0% when chemical treatment conditions are severe.

Mn is an element necessary for the securing of strength. At least 0.50% of Mn must be added. In order to secure quenchability and stable strength, it is preferable to add more than 2.0% of Mn. As, however, excessive addition tends to cause micro- and macro-segregations that deteriorate hole-expandability, the Mn addition should not be more than 3.5%.

P is an element that increases the strength of steel and enhances corrosion resistance when added with Cu. However, the P content should be not more than 0.2% because excessive addition deteriorates weldability, workability and toughness. Therefore, the P content is not more than 0.2%. Particularly when corrosion resistance is not important, it is preferable to keep the P content not more than 0.03% by attaching importance to workability.

S is one of the most important additive elements used in the present invention. S dramatically enhances hole-expandability by forming sulfides, which, in turn, form nucleus of (Ti, Nb)N, by combining with Mg and contributing to the particle size refinement of (Ti, Nb)N by inhibiting the growth thereof.

In order to obtain this effect, it is necessary to add not less than 0.0005% of S, and it is preferable to add not less than 0.001% of S. However, the upper limit of S addition is set at 0.009% because excessive addition forms Mg-sulfides and, thereby, deteriorates hole-expandability.

In order to secure workability, N content should preferably be as low as possible as N contributes to the formation of (Ti, Nb)N. The N content should be not more than 0.009% as coarse TiN is formed and workability deteriorates thereabove.

Mg is one of the most important additive elements used in the present invention. Mg forms oxides by combining with oxygen and sulfides by combining with S. The Mg-oxides and Mg-sulfides thus formed provide smaller precipitates and more uniform dispersion than in conventional steels prepared with no Mg addition.

The finely dispersed precipitates in steel effectively enhance hole-expandability by contributing to fine dispersion of (Ti, Nb)N.

Mg must be added not less than 0.0006% as sufficient effect is unattainable therebelow. In order to obtain sufficient effect, it is preferable to add not less than 0.0015% of Mg.

Meanwhile, the upper limit of Mg addition is set at 0.01% as addition in excess of 0.01% not only causes saturation of the improving effect but also deteriorates hole-expandability and ductility by deteriorating the degree of steel cleanliness.

O is one of the most important additive elements used in the present invention. O contributes to the enhancement of hole-expandability by forming oxides by combining with Mg. However, the upper limit of O content is set at 0.005% because excessive addition deteriorates the degree of steel cleanliness and thereby causes the deterioration of ductility.

Ti and Nb are among the most important additive elements used in the present invention. Ti and Nb effectively form carbides, increase the strength of steel, contribute to the homogenization of hardness and, thereby, improve hole-expandability. Ti and Nb form fine and uniform nitrides around the nucleus of Mg-oxides and Mg-sulfides. It is considered that the nitrides thus formed inhibit the generation of coarse cracks and, as a result, dramatically enhance hole-expandability by forming fine voids and inhibiting stress concentration.

In order to effectively achieve these effects, it is necessary to add at least not less than 0.01% of each Nb and Ti.

Additions of Ti and Nb should respectively be not more than 0.20% and 0.10% because excessive addition causes deterioration of ductility by precipitation strengthening. Ti and Nb produce the desired effects when added either singly or in combination.

Furthermore, one or more of the following elements may also be added to the steel sheets according to the present invention.

Ca, Zr and REMs (rare-earth-metals) control the shape of sulfide inclusions and, thereby, effective enhance hole-expandability. In order to obtain this effect, not less than 0.0005% of one or more of Ca, Zr and REMs should be added. Meanwhile, the upper limit of addition is set at 0.01% because excessive addition lowers the degree of steel cleanliness and, thereby, impairs hole-expandability and ductility.

Cu enhances corrosion resistance when added together with P. In order to obtain this effect, it is preferable to add not less than 0.04% of Cu. However, the upper limit of addition is set at 0.4% because excessive addition increases quench hardenability and impairs ductility.

Ni is an element that inhibits hot cracking resulting from the addition of Cu. In order to obtain this effect, it is preferable to add not less than 0.02% of Ni. However, the upper limit of addition is set at 0.3% because excessive addition increases quench hardenability and impairs ductility, as in the case of Cu.

Mo effectively improves hole-expandability by inhibiting the formation of cementite. Addition of not less than 0.02% of Mo is necessary for obtaining this effect. However, the upper limit of addition is set at 0.5% because Mo too enhances quench hardenability and, therefore, excessive addition thereof lowers ductility.

V is an element that contributes to the securing of strength by forming carbides. In order to obtain this effect, not less than 0.02% of V must be added. However, the upper limit of addition is set at 0.1% because excessive addition lowers ductility and proves costly.

Cr, like V, is an element that contributes to the securing of strength by forming carbides. In order to obtain this effect, not less than 0.02% of Cr must be added. However, the upper limit of addition is set at 1.0% because Cr too enhances quench hardenability and, therefore, excessive addition thereof lowers ductility.

B is an element that effectively reduces fabrication cracking that is a problem with ultra-high tensile steels. In order to obtain this effect, not less than 0.0003% of B must be added. However, the upper limit of addition is set at 0.001% because B too enhances quench hardenability and, therefore, excessive addition thereof lowers ductility.

Through various studies intended for finding solutions for the problems described above, the inventors discovered that it is possible to finely disperse (Nb, Ti)N by using the Mg-oxides and Mg-sulfides that are obtainable by adjusting the amounts of addition of O, Mg, Mn and S under certain conditions.

That is to say, it becomes possible to use the action as the nucleus and the action to inhibit growth described earlier by allowing adequate precipitation of Mg-oxides and allowing precipitation of Mg-sulfides by controlling the precipitation temperature thereof while impeding the precipitation of Mg-sulfides. In order to make this goal possible, the following three equations were derived.

As the present invention uses Mg-sulfides in addition to Mg-oxides, the amount of addition of Mg must be greater than that of O. While O forms oxides with Al and other elements, the inventors discovered that the effective-O that combines with Mg is 80% of the assayed amount. Thus, the amount of Mg addition to form a large enough quantity of sulfides to realize the improvement of hole-expandability should be greater than 80% of the assayed amount. Therefore, the amount of Mg addition must satisfy equation (1).

S, which is essential in forming Mg-sulfides, forms Mn-sulfides when present in large quantities. When precipitating in small quantities, Mn-sulfides are present mixed with Mg-sulfides and have no effect to deteriorate hole-expandability. When precipitating in large quantities, however, Mn-sulfides precipitate singly or affect the properties of Mg-sulfides, and thereby deteriorate hole-expandability, though details are unknown. Therefore, the quantity of S must satisfy equation (2) in respect of Mn and the effective amount of O.

When both of Mn and S are present in large quantities, Mn-sulfides precipitate at high temperatures, inhibit the production of Mg-sulfides and prevent sufficient improvement of hole-expandability. Therefore, the quantities of Mn and S must satisfy equation (3).

$$[\text{Mg }\%] \geqq ([\text{O }\%]/16 \times 0.8) \times 24 \quad (1)$$

$$[\text{S }\%] \leqq ([\text{Mg }\%]/24 - [\text{O }\%]/16 \times 0.8 + 0.00012) \times 32 \quad (2)$$

$$[\text{S }\%] \leqq 0.0075/[\text{Mn }\%] \quad (3)$$

In order to relieve stress expansion during hole expansion and improve hole-expandability by forming fine uniform voids in the cross section of punched holes, it is important to achieve fine and uniform dispersion of (Nb, Ti)N. (Nb, Ti)N does not become the starting point for forming fine and uniform voids when too small in size and becomes the starting point for coarse cracks when too large.

It is considered that if the number of the precipitates is few, the number of fine voids formed during punching is too few to inhibit the occurrence of coarse cracks.

Through various studies the inventors discovered that combined precipitation of MgO and MgS can be used for achieving uniform and fine precipitation of (Nb, Ti)N. The inventors also discovered that not less than 3.0 μm and not more than 3.0 μm of the combined precipitates of MgO, MgS and (Nb, Ti)N must be present under the condition of not less than $5.0 \times 10^2/mm^2$ and not more than $1.0 \times 10^7/mm^2$ in order to achieve the desired effect of the combined precipitation. The presence of $Al_2O_3$ and $SiO_2$ in the composite oxides does not impair the effect. The presence of small quantities of MnS sulfide is not deleterious, too.

The dispersion condition of the composite precipitates specified by the present invention is quantified, for example, by the method described below. Replica specimens taken at random from the base steel sheet are viewed through a transmission electron microscope (TEM), with a magnification of 5000 to 20000, over an area of at least 5000 $\mu m^2$, or preferably 50000 $\mu m^2$. The number of the composite inclusions is counted and converted to the number per unit area.

The oxides and (Nb, Ti)N are identified by chemical composition analysis by energy dispersion X-ray spectroscopy (EDS) attached to TEM and crystal structure analysis of electron diffraction images taken by TEM. If it is too complicated to apply this identification to all of the composite inclusions determined, the following method may be applied for the sake of brevity.

First, the numbers of the composite inclusions are counted by shape and size by the method described above. Then, more than ten samples taken from the different shape and size groups are identified by the method described above and the ratios of the oxides and (Nb, Ti)N are determined. Then, the numbers of the inclusions determined first are multiplied by the ratios.

When carbides in steel interfere with said TEM observation, application of heat treatment to agglomerate, coarsen or melt the carbides facilitates the observation of the composite inclusions.

Si and Al are very important elements for the structure control to secure ductility. However, Si sometimes produces, in the hot-rolling process, surface irregularities called Si-scale which are detrimental to product appearance, formation of chemical treatment films and adherence of paints.

Therefore, plentiful addition of Si is undesirable when chemical treatability is critical. Compatibility between ductility and chemical treatability in such cases can be obtained by substituting Al for Si. If, however, the additions of both Si and Al are too much, the percentage of the ferrite phase becomes too great to provide the desired strength.

In order, therefore, to secure adequate strength and ductility, the combined content of Si and Al must satisfy equation (4). Particularly when ductility is important, the combined content should preferably be not less than 0.9.

$$[Si\ \%]+2.2\times[Al\ \%]\geqq 0.35 \quad (4)$$

Next, the structure of steel sheets according to the present invention will be described.

Being a technology to improve the cross-sectional properties to punched holes, the present invention produces the desired effect in steels whose structure contains any of ferrite, bainite and martensite.

However, steel structure must be controlled according to the required mechanical properties because steel structure affects mechanical properties.

(1) Steel Sheet Primarily Comprising Bainite (Steel Sheet B of the Present Invention)

In order to secure strength of over 980 MPa, it is necessary to strengthen the structure of steel. In order to enhance hole-expandability, among various workabilities, the steel structure must primarily comprise bainite.

It is preferable to contain ferrite as a second phase in order to enhance ductility. In the steel sheet B of the present invention, residual austenite does not mar the effect of the present invention, but coarse cementite and pearlite are undesirable because the presence thereof lessens the end-face properties improving effect of the Mg-precipitates.

Ductility and hole-expandability of steels whose strength exceeds 980 N/mm$^2$ deteriorate with increasing strength. In this connection, the inventors discovered that limiting the contents of C, Mn, Ti and Nb in steels primarily comprising bainite is effective for securing ductility while maintaining strength as well as the hole-expandability enhancing effect by the improvement of the end-face properties of punched holes by Mg-precipitates.

That is to say, the inventors derived the following three equations by making the most of TiC precipitation strengthening and clarifying the effects of structure strengthening by Mn and C on steel properties, as explained below.

As the solid solution of Ti increases when the amount of C added is smaller than that of Ti, with a resulting deterioration of ductility, $0.9\leqq 48/12\times C/Ti$. If C content is greater than Ti content, TiC precipitates during hot-rolling, thereby marring the strength enhancing effect and deteriorating hole-expandability through the increase of C in the second phase.

As this leads to the lessening of the end-face properties improving effect of Mg-precipitates, $48/12\times C/Ti$ should not be greater than 1.7.

That is to say, the Ti and C contents must satisfy equation (5).

$$0.9\leqq 48/12\times C/Ti<1.7 \quad (5)$$

It is preferable $0.9\leqq 48/12\times C/Ti<1.3$ particularly when hole-expandability is important.

As the amount of Mn addition increases, ferrite formation is inhibited and the percentage of the second phase increases, which, in turn, facilitates the securing of strength but brings about the lowering of ductility. Meanwhile, C hardens the second phase, thereby deteriorating hole-expandability and improving ductility.

In order, therefore, to secure the ductility required by the tensile-strength in excess of 980 N/mm$^2$, the C and Mn contents must satisfy equation (6).

$$50227\times C-4479\times Mn>-9860 \quad (6)$$

In order to secure workability, it is necessary to satisfy the two equations given above. With steel sheets whose strength is of the order of 780 N/mm$^2$, it is relatively easy to satisfy the two equations while securing strength. In order to secure strength in excess of 980 N/mm$^2$, however, addition of C that deteriorates hole-expandability and Mn that deteriorates ductility is inevitable.

In order to secure strength in excess of 980 N/mm$^2$, it is necessary to control steel composition within the range that satisfies equation (7) while satisfying the two equations given above.

$$811\times C+135\times Mn+602\times Ti+794\times Nb>465 \quad (7)$$

Next, the manufacturing method will be described.

In order to prevent ferrite formation and obtain good hole-expandability, finish-rolling must be completed at a temperature of not lower than the $Ar_3$ transformation point. It is, however, preferable, to complete finish-rolling at a temperature of not higher than 950° C. because steel structure coarsens, with a resulting lowering of strength and ductility.

In order to inhibit the formation of carbides deleterious to hole-expandability and obtain high hole-expandability, the cooling rate must be not less than 20° C./s.

The coiling temperature must be not lower than 300° C. because hole-expandability deteriorates as a result of martensite formation therebelow.

The bainite formed at low temperatures, when present as the second phase, deteriorates hole-expandability, though not as much as is done by martensite. It is therefore preferable to coil the steel sheet at a temperature not lower than 350° C.

The coiling temperature should be not higher than 600° C. because pearlite and cementite deleterious to hole-expandability are formed thereabove.

Air-cooling applied in the course of continuous cooling effectively enhances ductility by increasing the proportion of ferrite phase. However, air-cooling sometimes forms pearlite that lowers not only ductility and hole-expandability, depending on the temperature and time thereof.

The air-cooling temperature should be not lower than 650° C. because pearlite deleterious to hole-expandability is formed early therebelow.

If the air-cooling temperature is over 750° C., on the other hand, ferrite formation delays to inhibit the attainment of the air cooling effect and expedites the formation of pearlite during subsequent cooling. Therefore, the air-cooling temperature is not higher than 750° C.

Air-cooling for over 15 seconds not only saturates the increase of ferrite but also imposes a load on the control of the subsequent cooling rate and coiling temperature. Therefore, the air-cooling time is not longer than 15 seconds.

(2) Steel Sheet Primarily Comprising Ferrite and Martensite (Steel Sheet FM of the Present Invention)

In order to secure high ductility and hole-expandability, it is necessary to secure a ductile steel structure because the end-face controlling technology is a technology related to the enhancement of the hole-expandability of steel sheets. It is therefore necessary that steel structure primarily comprises ferrite and martensite.

In order to secure high ductility, it is preferable that ferrite content is not less than 50%. While residual austenite does not bar the effect of the present invention in steel sheet FM, coarse cementite and pearlite, which lessen the end-face properties improving effect of Mg-precipitates, are undesirable.

In the hot-rolling process, the desired structure must be formed in a short time after finish-rolling, and steel composition strongly affects the formation of the desired structure. In order to enhance the ductility of steel whose structure primarily comprises ferrite and martensite, it is important to secure an adequate amount of ferrite.

In order to secure the adequate amount of ferrite effective for the enhancement of ductility, C, si, Mn and Al contents must satisfy equation (8) given below. If the value of equation (8) is smaller than −100, ductility deteriorates because an adequate amount of ferrite is not obtained and the percentage of the second phase increases.

$$-100 \leqq -300[C\ \%]+105[Si\ \%]-95[Mn\ \%]+233[Al\ \%] \quad (8)$$

The inventors conducted studies to discover means to enhance ductility of steels whose structure primarily comprises ferrite and martensite without lessening the hole-expandability improving effect of Mg-precipitates through the improvement of the end-face properties of punched holes. Through the studies, the inventors discovered that control of the shape and particle size of ferrite is conducive to ductility enhancement, as explained below.

The shape of ferrite grains is one of the important indexes for the ductility enhancement of steel sheet FM according to the present invention. Generally, high-alloy steels contain many ferrite grains elongating in the rolling direction. Through studies, the inventors discovered that the elongated ferrite grains induce the deterioration of ductility and lowering the probability of presence of crystal grains having a short diameter (ds) to long diameter (dl) ratio (ds/dl) smaller than 0.1 is effective.

In order to ensure the enhancement of ductility by the control of ferrite grains, it is necessary that ferrite grains whose ds/dl ratio is not smaller than 0.1 account for not less than 80% of all ferrite grains.

The size of ferrite grains is one of the most important indexes for the ductility enhancement according to the present invention. Generally, crystal grains grow smaller with increasing strength. Through studies the inventors discovered that, at the same strength level, sufficiently grown ferrite grains contribute to ductility enhancement.

In order to ensure the enhancement of ductility, it is necessary that ferrite grains not smaller than 2 μm account for not less than 80% of all ferrite grains.

Next, the manufacturing method will be described.

In order to prevent ferrite formation and obtain good hole-expandability, finish-rolling must be completed at a temperature of not lower than the $Ar_3$ transformation point. It is, however, preferable, to complete finish-rolling at a temperature not higher than 950° C. because steel structure coarsens, with a resulting lowering of strength and ductility. In order to inhibit the formation of carbides deleterious to hole-expandability and obtain high hole-expandability, the cooling rate must be not less than 20° C./second.

Coiling temperature should be lower than 300° C. because martensite is not formed thereabove and, as a result, the desired strength becomes unobtainable. In order to secure adequate strength and achieve sufficient ductility improvement, it is preferable to coil at a temperature not higher than 200° C.

Air-cooling applied in the course of continuous cooling effectively enhances ductility by increasing the proportion of ferrite phase. However, air-cooling sometimes forms pearlite that lowers not only ductility and hole-expandability, depending on the temperature and time thereof.

The air-cooling temperature should be not lower than 650° C. because pearlite deleterious to hole-expandability is formed early therebelow.

If the air-cooling temperature is over 750° C., on the other hand, ferrite formation delays to inhibit the attainment of the air cooling effect and expedite the formation of pearlite during subsequent cooling. Therefore, the air-cooling temperature is not higher than 750° C.

Air-cooling for over 15 seconds not only saturates the increase of ferrite but also imposes load on the control of the subsequent cooling rate and coiling temperature. Therefore, the air-cooling time is not longer than 15 seconds.

(3) Steel Sheet Primarily Comprising Ferrite and Bainite (Steel Sheet FB of the Present Invention)

Because the end-face controlling technology is a technology related to the enhancement of hole-expandability, hole-expandability is strongly affected by the ductility and hole-expandability (base properties) of the base metal. Steel sheets for such members as automobile suspensions that demand high hole-expandability should have a good balance between ductility and hole-expandability. Therefore, it is necessary to further enhance hole-expandability by using the end-face controlling technology.

In order to obtain higher hole-expandability, it is necessary that steel structure primarily comprises ferrite and bainite. It is preferable that ferrite content is not lower than 50% because particularly high ductility is obtainable.

While residual austenite does not bar the effect of the present invention in steel sheet FB, coarse cementite and pearlite, which lessen the end-face properties improving effect of Mg-precipitates, are undesirable.

In the hot-rolling process, the desired structure must be formed in a short time after finish-rolling, and steel composition strongly affects the formation of the desired structure. In order to enhance the ductility of steel whose structure primarily comprises ferrite and bainite, it is important to secure an adequate amount of ferrite.

In order to secure the adequate amount of ferrite effective for the enhancement of ductility, C, Si, Mn and Al contents must satisfy equation (8) given below. If the value of equation (8) is smaller than −100, ductility deteriorates because an adequate amount of ferrite is not obtained and the percentage of the second phase increases.

$$-100 \leqq -300[C\ \%]+105[Si\ \%]-95[Mn\ \%]+233[Al\ \%] \quad (8)$$

The inventors conducted studies to discover means to enhance ductility of steels whose structure primarily comprises ferrite and martensite without lessening the hole-expandability improving effect of Mg-precipitates through the improvement of the end-face properties of punched holes. Through the studies, the inventors discovered that control of the shape and particle size of ferrite is conducive to ductility enhancement, as explained below.

The shape of ferrite grains is one of the important indexes for the ductility enhancement of steel sheet FM according to the present invention. Generally, high-alloy steels contain many ferrite grains elongating in the rolling direction. Through studies, the inventors discovered that the elongated ferrite grains induce the deterioration of ductility and lowering the probability of presence of crystal grains having a short diameter (ds) to long diameter (dl) ratio (ds/dl) smaller than 0.1 is effective.

In order to ensure the enhancement of ductility by the control of ferrite grains, it is necessary that ferrite grains whose ds/dl ratio is not smaller than 0.1 account for not less than 80% of all ferrite grains.

The size of ferrite grains is one of the most important indexes for the ductility enhancement according to the present invention. Generally, crystal grains grow smaller with increasing strength. Through studies the inventors discovered that, at the same strength level, sufficiently grown ferrite grains contribute to ductility enhancement.

In order to ensure the enhancement of ductility, it is necessary that ferrite grains not smaller than 2 μm account for not less than 80% of all ferrite grains.

Next, the manufacturing method will be described.

In order to prevent ferrite formation and obtain good hole-expandability, finish-rolling must be completed at a temperature not lower than the $Ar_3$ transformation point. It is, however, preferable to complete finish-rolling at a temperature not higher than 950° C. because steel structure coarsens with a resulting lowering of strength and ductility.

In order to inhibit the formation of carbides deleterious to hole-expandability and obtain high hole-expandability, the cooling rate must be not less than 20° C./s.

The coiling temperature must be not lower than 300° C. because hole-expandability deteriorates as a result of martensite formation therebelow.

The bainite formed at low temperatures, when present as the second phase, deteriorates hole-expandability, though not as much as is done by martensite. It is therefore preferable to coil the steel sheet at a temperature not lower than 350° C.

The coiling temperature should be not higher than 600° C. because pearlite and cementite deleterious to hole-expandability are formed thereabove.

Air-cooling applied in the course of continuous cooling effectively enhances ductility by increasing the proportion of ferrite phase. However, air-cooling sometimes forms pearlite that lowers ductility and hole-expandability, depending on the temperature and time thereof.

The air-cooling temperature should be not lower than 650° C. because pearlite deleterious to hole-expandability is formed early therebelow.

If the air-cooling temperature is over 750° C., on the other hand, ferrite formation delays to inhibit the attainment of the air cooling effect and expedite the formation of pearlite during subsequent cooling. Therefore, the air-cooling temperature is not higher than 750° C.

Air-cooling for over 15 seconds not only saturates the increase of ferrite but also imposes a load on the control of the subsequent cooling rate and coiling temperature. Therefore, the air-cooling time is not longer than 15 seconds.

Next, the present invention will be described by reference to examples thereof.

EXAMPLE 1

Example 1 is one of the steels F according to the present invention.

Steels of compositions and properties shown in Tables 1 and 2 were prepared and continuously cast to slabs by the conventional process. Reference characters A to Z designate the steels whose compositions are according to the present invention, whereas reference characters a, b, c, e and f designate steels whose C, Mn, O, S and Mg contents, respectively, are outside the scope of the present invention.

Steels a, b, c, d, e, f and g, respectively, did not satisfy equation (5), equations (3) and (6), equations (1) and (2), equation (4), equations (2) and (3), equation (1), and equation (7). The number of precipitates in steel f was outside the scope of the present invention.

The steels were heated in a heating furnace at temperatures not lower than 1200° C. and then hot-rolled to sheets ranging in thickness from 2.6 to 3.2 mm. Tables 3 and 4 show the hot-rolling conditions.

In Tables 3 and 4, the cooling rates of A4 and J2, the air-cooling start temperatures of B3 and F3, and the coiling temperatures of E3, G3 and Q4 are outside the scope of the present invention.

Tensile tests and hole-expanding tests were performed on JIS No. 5 specimens taken from the hot-rolled steel sheets thus obtained. Hole-expandability (λ) was evaluated by expanding a 10 mm diameter punched hole with a 60°-conical punch and using equation $\lambda=(d-dO)/dO\times100$ wherein d=the hole diameter when a crack has penetrated through the sheet and dO is the initial hole diameter (10 mm).

Figure 2:
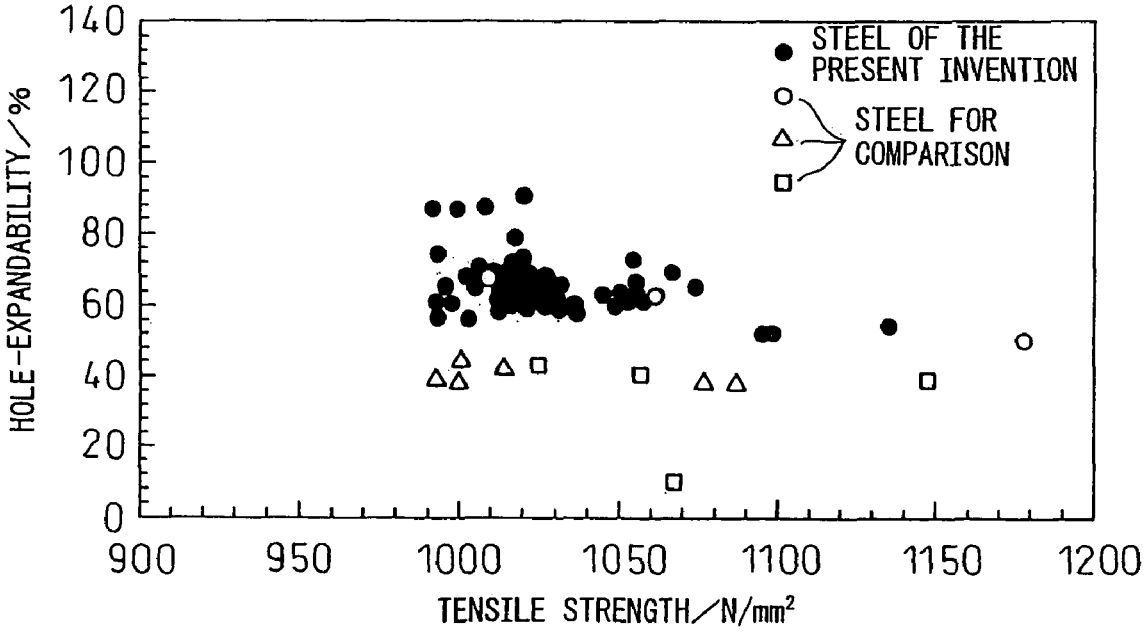
FIG. 2 shows the relationship between tensile strength and hole-expanding ratio.

Table 2 shows the tensile strength TS, elongation El and hole-expandability λ of the individual specimens. FIG. 1 shows the relationship between strength and ductility and FIG. 2 shows the relationship between strength and hole-expandability (ratio). It is obvious that the steels according to the present invention excel over the steels tested for comparison in either or both of ductility and hole-expandability (ratio). Steel g1 did not achieve the desired strength.

Thus, the present invention provides hot-rolled high-strength steel sheets excellent in both hole-expandability and ductility while securing the desired strength of 980 N/mm$^2$.

TABLE 1

| Steel | C | Si | Mn | P | S | N | Mg | Al | Nb | Ti | Ca | O | Remarks |
|---|---|---|---|---|---|---|---|---|---|---|---|---|---|
| | mass % | | | | | | | | | | | | |
| A | 0.062 | 1.23 | 2.4 | 0.004 | 0.0010 | 0.005 | 0.0023 | 0.035 | 0.044 | 0.179 | — | 0.0014 | Steel of the present invention |
| B | 0.060 | 1.30 | 2.5 | 0.007 | 0.0020 | 0.003 | 0.0040 | 0.040 | 0.035 | 0.170 | — | 0.0015 | Steel of the present invention |
| C | 0.055 | 1.40 | 2.8 | 0.006 | 0.0025 | 0.003 | 0.0030 | 0.050 | 0.014 | 0.150 | — | 0.0012 | Steel of the present invention |
| D | 0.050 | 1.00 | 2.2 | 0.006 | 0.0010 | 0.004 | 0.0040 | 0.030 | 0.035 | 0.170 | — | 0.0015 | Steel of the present invention |
| E | 0.060 | 0.03 | 2.2 | 0.006 | 0.0028 | 0.004 | 0.0030 | 0.180 | 0.044 | 0.180 | — | 0.0010 | Steel of the present invention |
| F | 0.065 | 0.50 | 2.2 | 0.006 | 0.0028 | 0.004 | 0.0030 | 0.200 | 0.044 | 0.180 | — | 0.0010 | Steel of the present invention |
| G | 0.050 | 1.30 | 2.4 | 0.008 | 0.0025 | 0.004 | 0.0044 | 0.036 | 0.040 | 0.150 | — | 0.0011 | Steel of the present invention |
| H | 0.030 | 1.30 | 2.5 | 0.006 | 0.0020 | 0.003 | 0.0040 | 0.033 | 0.050 | 0.130 | — | 0.0015 | Steel of the present invention |
| I | 0.080 | 0.50 | 2.0 | 0.010 | 0.0035 | 0.004 | 0.0017 | 0.032 | 0.055 | 0.190 | — | 0.0008 | Steel of the present invention |
| J | 0.080 | 0.50 | 3.0 | 0.003 | 0.0018 | 0.002 | 0.0035 | 1.300 | 0.035 | 0.195 | 0.003 | 0.0015 | Steel of the present invention |
| K | 0.050 | 1.40 | 2.7 | 0.020 | 0.0025 | 0.003 | 0.0035 | 0.034 | 0.030 | 0.130 | — | 0.0015 | Steel of the present invention |
| L | 0.050 | 0.60 | 2.0 | 0.012 | 0.0035 | 0.003 | 0.0080 | 0.030 | 0.090 | 0.190 | 0.002 | 0.0007 | Steel of the present invention |
| M | 0.060 | 1.20 | 2.2 | 0.015 | 0.0030 | 0.002 | 0.0050 | 0.005 | 0.030 | 0.190 | — | 0.0040 | Steel of the present invention |
| N | 0.050 | 1.30 | 2.5 | 0.012 | 0.0020 | 0.003 | 0.0010 | 0.800 | 0.035 | 0.130 | — | 0.0007 | Steel of the present invention |
| O | 0.040 | 1.20 | 2.5 | 0.011 | 0.0025 | 0.002 | 0.0025 | 0.030 | 0.000 | 0.170 | 0.002 | 0.0012 | Steel of the present invention |
| P | 0.050 | 1.10 | 2.6 | 0.006 | 0.0025 | 0.004 | 0.0030 | 0.030 | 0.037 | 0.124 | 0.002 | 0.0014 | Steel of the present invention |
| Q | 0.050 | 1.10 | 2.6 | 0.009 | 0.0020 | 0.005 | 0.0030 | 0.037 | 0.030 | 0.140 | — | 0.0010 | Steel of the present invention |
| R | 0.055 | 0.10 | 2.6 | 0.006 | 0.0025 | 0.002 | 0.0029 | 0.450 | 0.030 | 0.140 | 0.002 | 0.0015 | Steel of the present invention |
| S | 0.055 | 0.50 | 2.6 | 0.009 | 0.0020 | 0.002 | 0.0022 | 0.200 | 0.035 | 0.140 | — | 0.0015 | Steel of the present invention |
| T | 0.070 | 0.90 | 2.2 | 0.008 | 0.0030 | 0.002 | 0.0040 | 0.035 | 0.040 | 0.170 | 0.002 | 0.0025 | Steel of the present invention |
| U | 0.070 | 0.95 | 2.2 | 0.008 | 0.0030 | 0.002 | 0.0035 | 0.035 | 0.070 | 0.170 | 0.002 | 0.0025 | Steel of the present invention |
| V | 0.070 | 1.30 | 2.2 | 0.070 | 0.0025 | 0.002 | 0.0030 | 0.040 | 0.035 | 0.155 | 0.002 | 0.0015 | Steel of the present invention |
| W | 0.050 | 1.30 | 2.4 | 0.007 | 0.0025 | 0.003 | 0.0040 | 0.034 | 0.040 | 0.155 | — | 0.0015 | Steel of the present invention |
| X | 0.060 | 1.20 | 2.3 | 0.017 | 0.0030 | 0.003 | 0.0020 | 0.080 | 0.030 | 0.170 | 0.002 | 0.0015 | Steel of the present invention |
| Y | 0.060 | 0.90 | 2.3 | 0.017 | 0.0030 | 0.002 | 0.0032 | 0.000 | 0.030 | 0.150 | — | 0.0015 | Steel of the present invention |

TABLE 1-continued

| Steel | C | Si | Mn | P | S | N | Mg | Al | Nb | Ti | Ca | O | Remarks |
|---|---|---|---|---|---|---|---|---|---|---|---|---|---|
| | mass % | | | | | | | | | | | | |
| Z | 0.060 | 0.90 | 2.3 | 0.016 | 0.0030 | 0.002 | 0.0035 | 0.033 | 0.025 | 0.170 | — | 0.0015 | Steel of the present invention |
| a | 0.210 | 1.30 | 2.2 | 0.120 | 0.0030 | 0.002 | 0.0031 | 0.005 | 0.030 | 0.080 | 0.002 | 0.0015 | Steel for Comparison |
| b | 0.050 | 1.00 | 3.6 | 0.020 | 0.0025 | 0.002 | 0.0040 | 0.030 | 0.030 | 0.170 | — | 0.0015 | Steel for Comparison |
| c | 0.060 | 1.00 | 2.2 | 0.020 | 0.0030 | 0.002 | 0.0030 | 0.035 | 0.035 | 0.170 | 0.002 | 0.0060 | Steel for Comparison |
| d | 0.050 | 0.20 | 2.5 | 0.010 | 0.0028 | 0.002 | 0.0029 | 0.030 | 0.030 | 0.150 | 0.002 | 0.0015 | Steel for Comparison |
| e | 0.055 | 1.10 | 2.5 | 0.010 | 0.0100 | 0.002 | 0.0040 | 0.020 | 0.020 | 0.150 | 0.002 | 0.0015 | Steel for Comparison |
| f | 0.070 | 0.90 | 2.2 | 0.010 | 0.0015 | 0.002 | 0.0003 | 0.025 | 0.025 | 0.170 | 0.002 | 0.0015 | Steel for Comparison |
| g | 0.070 | 0.90 | 1.4 | 0.010 | 0.0020 | 0.002 | 0.0040 | 0.030 | 0.030 | 0.170 | 0.002 | 0.0007 | Steel for Comparison |

TABLE 2

| Steel | Right-hand side of equation 1 | Right-hand side of equation 2 | Right-hand side of equation 3 | Left-hand side of equation 4 | Middle side of equation 5 | Left-hand side of equation 6 | Left-hand side of equation 7 | Number of precipitates/ $mm^2$ | $Ar_3$ ° C. | Remarks |
|---|---|---|---|---|---|---|---|---|---|---|
| A | 0.0017 | 0.0047 | 0.0031 | 1.31 | 1.39 | −7815 | 522 | 2.1E+03 | 743 | Steel of the present invention |
| B | 0.0018 | 0.0068 | 0.0030 | 1.39 | 1.41 | −8184 | 516 | 4.3E+03 | 743 | Steel of the present invention |
| C | 0.0014 | 0.0059 | 0.0027 | 1.51 | 1.47 | −9779 | 524 | 3.7E+03 | 729 | Steel of the present invention |
| D | 0.0018 | 0.0068 | 0.0034 | 1.07 | 1.18 | −7342 | 468 | 3.8E+03 | 759 | Steel of the present invention |
| E | 0.0012 | 0.0062 | 0.0034 | 0.43 | 1.33 | −6840 | 489 | 3.9E+03 | 728 | Steel of the present invention |
| F | 0.0012 | 0.0062 | 0.0034 | 0.94 | 1.44 | −6589 | 493 | 3.9E+03 | 738 | Steel of the present invention |
| G | 0.0013 | 0.0079 | 0.0031 | 1.38 | 1.33 | −8238 | 487 | 5.1E+03 | 755 | Steel of the present invention |
| H | 0.0018 | 0.0068 | 0.0030 | 1.37 | 0.92 | −9691 | 480 | 4.3E+03 | 758 | Steel of the present invention |
| I | 0.0010 | 0.0048 | 0.0038 | 0.57 | 1.68 | −4940 | 493 | 3.1E+03 | 744 | Steel of the present invention |
| J | 0.0018 | 0.0061 | 0.0025 | 3.36 | 1.64 | −9419 | 615 | 3.7E+03 | 679 | Steel of the present invention |
| K | 0.0018 | 0.0061 | 0.0028 | 1.47 | 1.54 | −9582 | 507 | 4.0E+03 | 741 | Steel of the present invention |
| L | 0.0008 | 0.0134 | 0.0038 | 0.67 | 1.05 | −6447 | 496 | 9.4E+03 | 762 | Steel of the present invention |
| M | 0.0048 | 0.0041 | 0.0034 | 1.21 | 1.26 | −6840 | 484 | 4.5E+03 | 761 | Steel of the present invention |
| N | 0.0008 | 0.0041 | 0.0030 | 3.06 | 1.54 | −8686 | 484 | 1.7E+03 | 749 | Steel of the present invention |
| O | 0.0014 | 0.0053 | 0.0030 | 1.27 | 0.94 | −9188 | 472 | 3.2E+03 | 751 | Steel of the present invention |
| P | 0.0017 | 0.0056 | 0.0029 | 1.17 | 1.61 | −9134 | 496 | 3.6E+03 | 736 | Steel of the present invention |
| Q | 0.0012 | 0.0062 | 0.0029 | 1.18 | 1.43 | −9134 | 500 | 3.5E+03 | 737 | Steel of the present invention |
| R | 0.0018 | 0.0053 | 0.0029 | 1.09 | 1.57 | −8883 | 504 | 3.4E+03 | 707 | Steel of the present invention |
| S | 0.0018 | 0.0044 | 0.0029 | 0.94 | 1.57 | −8883 | 508 | 2.5E+03 | 718 | Steel of the present invention |
| T | 0.0030 | 0.0052 | 0.0034 | 0.98 | 1.65 | −6338 | 488 | 4.3E+03 | 747 | Steel of the present invention |
| U | 0.0030 | 0.0045 | 0.0034 | 1.03 | 1.65 | −6338 | 512 | 3.8E+03 | 748 | Steel of the present invention |
| V | 0.0018 | 0.0054 | 0.0034 | 1.39 | 1.81 | −6338 | 475 | 3.5E+03 | 771 | Steel of the present invention |
| W | 0.0018 | 0.0068 | 0.0031 | 1.37 | 1.29 | −8238 | 490 | 4.5E+03 | 754 | Steel of the present invention |
| X | 0.0018 | 0.0041 | 0.0033 | 1.38 | 1.41 | −7288 | 485 | 2.8E+03 | 755 | Steel of the present invention |
| Y | 0.0018 | 0.0057 | 0.0033 | 0.90 | 1.60 | −7288 | 473 | 4.0E+03 | 747 | Steel of the present invention |
| Z | 0.0018 | 0.0061 | 0.0033 | 0.97 | 1.41 | −7288 | 481 | 4.3E+03 | 747 | Steel of the present invention |
| a | 0.0018 | 0.0056 | 0.0034 | 1.31 | 10.50 | 694 | 539 | 3.9E+03 | 712 | Steel for Comparison |
| b | 0.0018 | 0.0068 | 0.0021 | 1.07 | 1.18 | −13613 | 653 | 4.5E+03 | 673 | Steel for Comparison |
| c | 0.0072 | −0.0018 | 0.0034 | 1.08 | 1.41 | −6840 | 476 | 1.5E+03 | 757 | Steel for Comparison |
| d | 0.0018 | 0.0053 | 0.0030 | 0.27 | 1.33 | −8686 | 492 | 3.6E+03 | 719 | Steel for Comparison |
| e | 0.0018 | 0.0068 | 0.0030 | 1.17 | 1.47 | −8435 | 488 | 8.3E+03 | 741 | Steel for Comparison |
| f | 0.0018 | 0.0018 | 0.0034 | 0.97 | 1.65 | −6338 | 476 | 3.0E+02 | 747 | Steel for Comparison |
| g | 0.0008 | 0.0081 | 0.0054 | 0.97 | 1.65 | −2755 | 372 | 4.7E+03 | 798 | Steel for Comparison |

* Provided, however, that $Ar_3 = 896 - 509\ (C\ \%) + 26.9\ (Si\ \%) - 63.5\ (Mn\ \%) + 229\ (P\ \%)$

TABLE 3

| Steel | Finishing Temperature ° C. | Cooling Rate ° C./s | Air-cooling Start Temperature ° C. | Air-cooling Time s | Coiling Temperature ° C. | Tensile Strength $N/mm^2$ | Elongation % | Hole-Expandability % | Remarks |
|---|---|---|---|---|---|---|---|---|---|
| A1 | 920 | 70 | 680 | 4 | 490 | 1050 | 14 | 64 | Steel of the present invention |
| A2 | 910 | 70 | 720 | 2 | 580 | 1095 | 15 | 52 | Steel of the present invention |
| A3 | 920 | 40 | — | — | 500 | 1067 | 14 | 69 | Steel of the present invention |
| A4 | 930 | 10 | — | — | 480 | 1057 | 9 | 41 | Steel for Comparison |
| B1 | 920 | 70 | 670 | 5 | 490 | 1044 | 14 | 64 | Steel of the present invention |
| B2 | 900 | 70 | 720 | 2 | 300 | 1019 | 14 | 65 | Steel of the present invention |
| B3 | 910 | 70 | 780 | 3 | 500 | 1061 | 10 | 63 | Steel for Comparison |
| B4 | 890 | 40 | — | — | 500 | 1073 | 14 | 65 | Steel of the present invention |
| C1 | 910 | 70 | 670 | 3 | 500 | 1053 | 12 | 62 | Steel of the present invention |
| C2 | 920 | 40 | — | — | 480 | 1055 | 12 | 67 | Steel of the present invention |
| D1 | 890 | 70 | 670 | 4 | 490 | 993 | 16 | 74 | Steel of the present invention |
| D2 | 930 | 70 | 680 | 3 | 550 | 1023 | 16 | 69 | Steel of the present invention |
| E1 | 930 | 70 | 670 | 3 | 500 | 1004 | 16 | 68 | Steel of the present invention |
| E2 | 920 | 40 | — | — | 480 | 1006 | 16 | 71 | Steel of the present invention |
| E3 | 920 | 70 | 720 | 3 | 620 | 1076 | 15 | 40 | Steel for Comparison |

TABLE 3-continued

| Steel | Finishing Temperature ° C. | Cooling Rate ° C./s | Air-cooling Start Temperature ° C. | Air-cooling Time s | Coiling Temperature ° C. | Tensile Strength N/mm$^2$ | Elongation % | Hole-Expandability % | Remarks |
|---|---|---|---|---|---|---|---|---|---|
| F1 | 910 | 70 | 680 | 3 | 500 | 1013 | 16 | 64 | Steel of the present invention |
| F2 | 910 | 40 | — | — | 500 | 1025 | 16 | 64 | Steel of the present invention |
| F3 | 890 | 70 | 630 | 4 | 500 | 1025 | 10 | 43 | Steel for Comparison |
| G1 | 920 | 70 | 680 | 3 | 500 | 1015 | 14 | 67 | Steel of the present invention |
| G2 | 920 | 70 | — | — | 480 | 1017 | 14 | 72 | Steel of the present invention |
| G3 | 930 | 40 | — | — | 620 | 1087 | 14 | 39 | Steel for Comparison |
| H1 | 910 | 70 | 690 | 3 | 480 | 1008 | 13 | 87 | Steel of the present invention |
| H2 | 900 | 40 | — | — | 480 | 1020 | 13 | 91 | Steel of the present invention |
| I1 | 920 | 70 | 680 | 3 | 520 | 1013 | 18 | 58 | Steel of the present invention |
| I2 | 910 | 40 | — | — | 500 | 1015 | 18 | 61 | Steel of the present invention |
| J1 | 880 | 70 | 670 | 4 | 500 | 1135 | 12 | 55 | Steel of the present invention |
| J2 | 870 | 10 | — | — | 500 | 1147 | 7 | 39 | Steel for Comparison |
| K1 | 910 | 70 | 670 | 4 | 450 | 1036 | 13 | 61 | Steel of the present invention |
| K2 | 890 | 70 | 680 | 4 | 550 | 1098 | 13 | 52 | Steel of the present invention |
| L1 | 890 | 70 | 670 | 3 | 500 | 1017 | 16 | 79 | Steel of the present invention |
| L2 | 910 | 40 | — | — | 550 | 1054 | 17 | 73 | Steel of the present invention |
| M1 | 890 | 70 | 670 | 3 | 480 | 1011 | 16 | 70 | Steel of the present invention |
| M2 | 890 | 50 | 680 | 3 | 500 | 1021 | 16 | 69 | Steel of the present invention |
| N1 | 880 | 70 | 680 | 3 | 500 | 1012 | 14 | 61 | Steel of the present invention |
| N2 | 890 | 30 | — | — | 500 | 1024 | 14 | 64 | Steel of the present invention |

TABLE 4

(Continued from Table 3)

| Steel | Finishing Temperature ° C. | Cooling Rate ° C./s | Air-cooling Start Temperature ° C. | Air-cooling Time s | Coiling Temperature ° C. | Tensile Strength N/mm$^2$ | Elongation % | Hole-Expandability % | Remarks |
|---|---|---|---|---|---|---|---|---|---|
| 01 | 920 | 70 | 670 | 5 | 500 | 999 | 14 | 87 | Steel of the present invention |
| 02 | 910 | 70 | 690 | 3 | 480 | 991 | 14 | 87 | Steel of the present invention |
| P1 | 890 | 70 | 680 | 3 | 480 | 1022 | 13 | 59 | Steel of the present invention |
| P2 | 900 | 70 | 700 | 4 | 500 | 1032 | 13 | 59 | Steel of the present invention |
| Q1 | 900 | 70 | 670 | 4 | 500 | 1026 | 13 | 64 | Steel of the present invention |
| Q2 | 890 | 150 | 660 | 5 | 480 | 1016 | 14 | 64 | Steel of the present invention |
| Q3 | 910 | 40 | — | — | 480 | 1028 | 13 | 69 | Steel of the present invention |
| Q4 | 920 | 40 | — | — | 200 | 993 | 14 | 40 | Steel for Comparison |
| R1 | 920 | 70 | 680 | 3 | 500 | 1020 | 14 | 60 | Steel of the present invention |
| R2 | 920 | 40 | — | — | 500 | 1032 | 14 | 66 | Steel of the present invention |
| S1 | 930 | 100 | 660 | 5 | 500 | 1028 | 14 | 60 | Steel of the present invention |
| S2 | 910 | 70 | 720 | 2 | 480 | 1018 | 14 | 60 | Steel of the present invention |
| T1 | 900 | 70 | 680 | 3 | 480 | 1012 | 16 | 59 | Steel of the present invention |
| T2 | 910 | 40 | — | — | 500 | 1034 | 16 | 60 | Steel of the present invention |
| U1 | 890 | 70 | 680 | 4 | 480 | 1036 | 16 | 58 | Steel of the present invention |
| U2 | 890 | 40 | — | — | 480 | 1048 | 16 | 60 | Steel of the present invention |
| V1 | 890 | 70 | 660 | 3 | 520 | 1003 | 16 | 56 | Steel of the present invention |
| V2 | 900 | 70 | 660 | 4 | 400 | 993 | 17 | 56 | Steel of the present invention |
| V3 | 890 | 40 | — | — | 550 | 1030 | 17 | 61 | Steel of the present invention |
| W1 | 920 | 70 | 700 | 3 | 500 | 1018 | 14 | 69 | Steel of the present invention |
| W2 | 930 | 70 | 660 | 3 | 580 | 1058 | 15 | 62 | Steel of the present invention |
| W3 | 910 | 40 | — | — | 480 | 1020 | 14 | 74 | Steel of the present invention |
| X1 | 900 | 70 | 690 | 3 | 500 | 1012 | 15 | 65 | Steel of the present invention |
| X2 | 930 | 70 | — | — | 480 | 1002 | 16 | 68 | Steel of the present invention |
| Y1 | 890 | 70 | 680 | 4 | 480 | 997 | 16 | 61 | Steel of the present invention |
| Y2 | 910 | 70 | 690 | 3 | 400 | 992 | 16 | 61 | Steel of the present invention |
| Z1 | 910 | 70 | 670 | 3 | 500 | 1005 | 15 | 65 | Steel of the present invention |
| Z2 | 910 | 70 | 680 | 3 | 400 | 995 | 16 | 66 | Steel of the present invention |
| a1 | 850 | 70 | 680 | 3 | 480 | 1067 | 7 | 10 | Steel for Comparison |
| b1 | 900 | 70 | 680 | 4 | 480 | 1178 | 5 | 51 | Steel for Comparison |
| c1 | 920 | 70 | 680 | 3 | 500 | 1001 | 16 | 45 | Steel for Comparison |
| d1 | 900 | 70 | 670 | 4 | 480 | 1009 | 6 | 68 | Steel for Comparison |
| e1 | 900 | 70 | 680 | 3 | 480 | 1014 | 14 | 43 | Steel for Comparison |
| f1 | 910 | 70 | 680 | 4 | 520 | 1000 | 17 | 39 | Steel for Comparison |
| g1 | 910 | 70 | 680 | 3 | 500 | 896 | 19 | 44 | Steel for Comparison |

EXAMPLE 2

Example 1 is one of the steels FM according to the present invention.

Steels of compositions and properties shown in Tables 5 and 6 were prepared and continuously cast to slabs by the conventional process. Reference characters A to Z designate the steels whose compositions are according to the present invention, whereas reference characters a, b, c, e and f designate steels whose C, Mn, O, S and Mg contents, respectively, are outside the scope of the present invention.

Steels b, c, d, e and f, respectively, did not satisfy equations (3) and (8), equations (1) and (2), equation (4), equations (2) and (3), equation (1), and equation (7). The number of precipitates in steels f and g was outside the scope of the present invention.

The steels were heated in a heating furnace at a temperatures not lower than 1200° C. and then hot-rolled to sheets ranging in thickness from 2.6 to 3.2 mm. Tables 7 and 8 show the hot-rolling conditions.

In Tables 7 and 8, the cooling rates of A4 and J2, the air-cooling start temperatures of B3 and F3, and the coiling temperatures of E3, G3 and Q4 are outside the scope of the present invention.

Tensile tests and hole-expanding tests were performed on JIS No. 5 specimens taken from the hot-rolled steel sheets thus obtained. Hole-expandability (λ) was evaluated by expanding a 10 mm diameter punched hole with a 60°-conical punch and using equation $\lambda=(d-dO)/dO\times100$ wherein d=the hole diameter when crack has penetrated through the sheet and dO is the initial hole diameter (10 mm).

Figure 3:
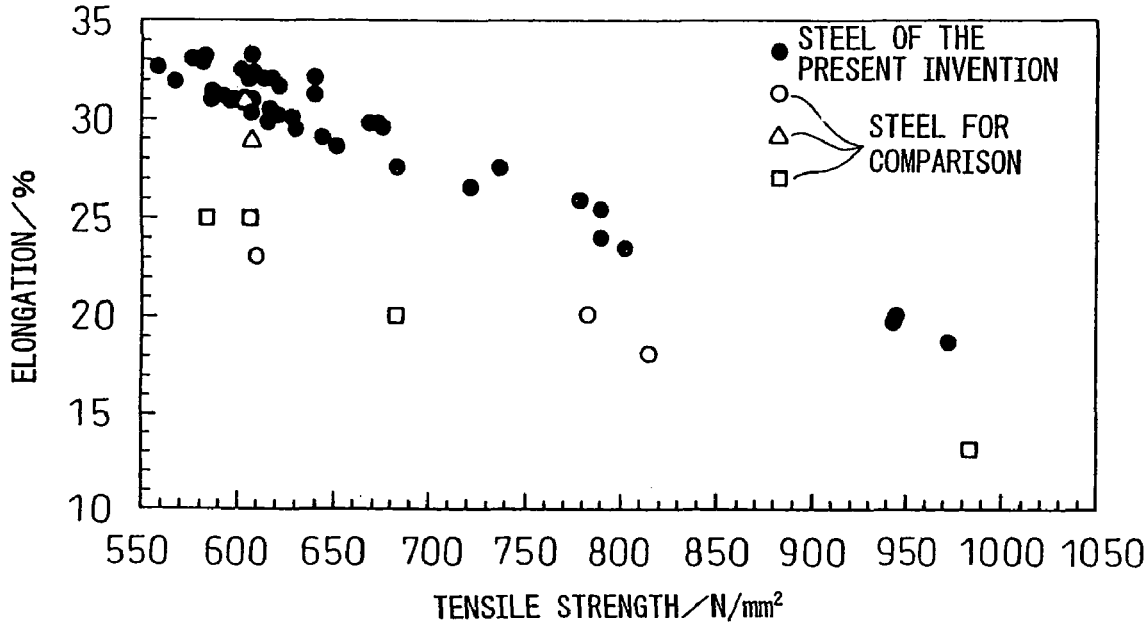
FIG. 3 shows the relationship between tensile strength and ductility.
Figure 4:
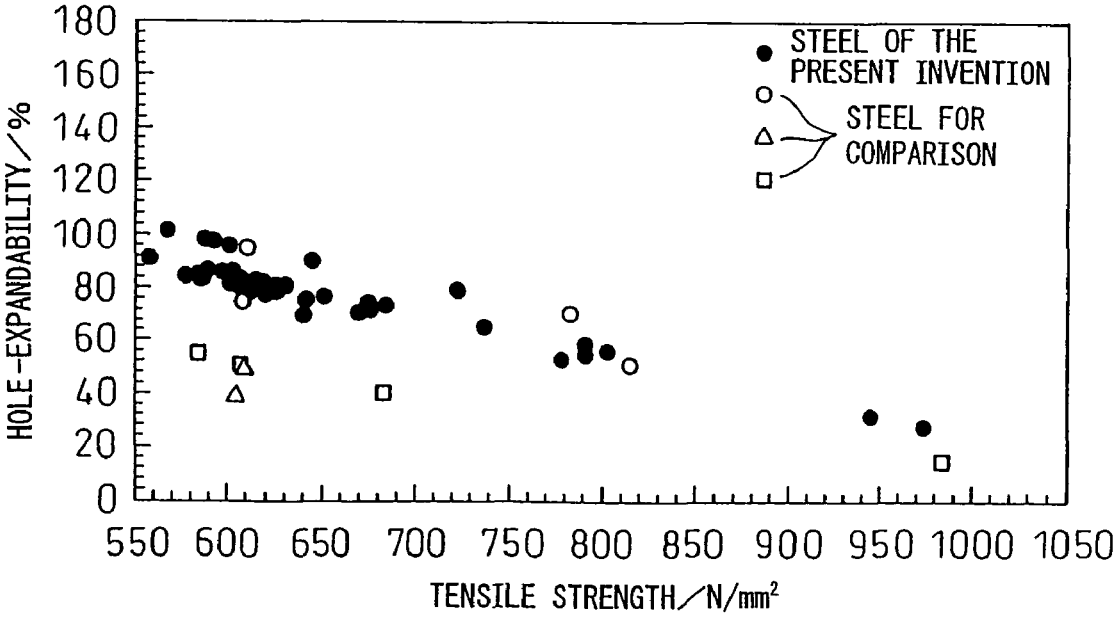
FIG. 4 shows the relationship between tensile strength and hole-expanding ratio.

Tables 7 and 8 show the tensile strength TS, elongation Eland hole-expandability λ of the individual specimens. FIG. 3 shows the relationship between strength and ductility and FIG. 4 shows the relationship between strength and hole-expandability (ratio). It is obvious that the steels according to the present invention excel over the steels tested for comparison in either or both of ductility and hole-expandability (ratio).

Figure 5:
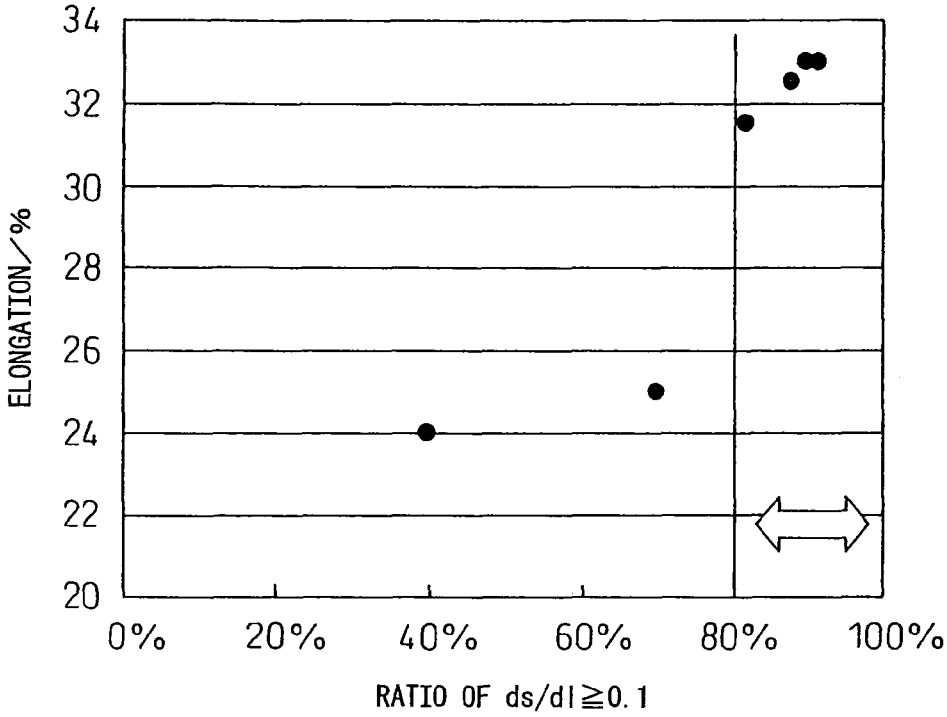
FIG. 5 shows the relationship between ductility and short-diameter to long-diameter ratio (ds/dl).

Table 9 and FIG. 5 show the relationship between ductility and the ratio at which the ratio (ds/dl) of short diameter (ds) to long diameter (dl) exceeds 0.1. It is obvious that high ductility is stably obtainable when the ratio is not less than 80%.

Figure 6:
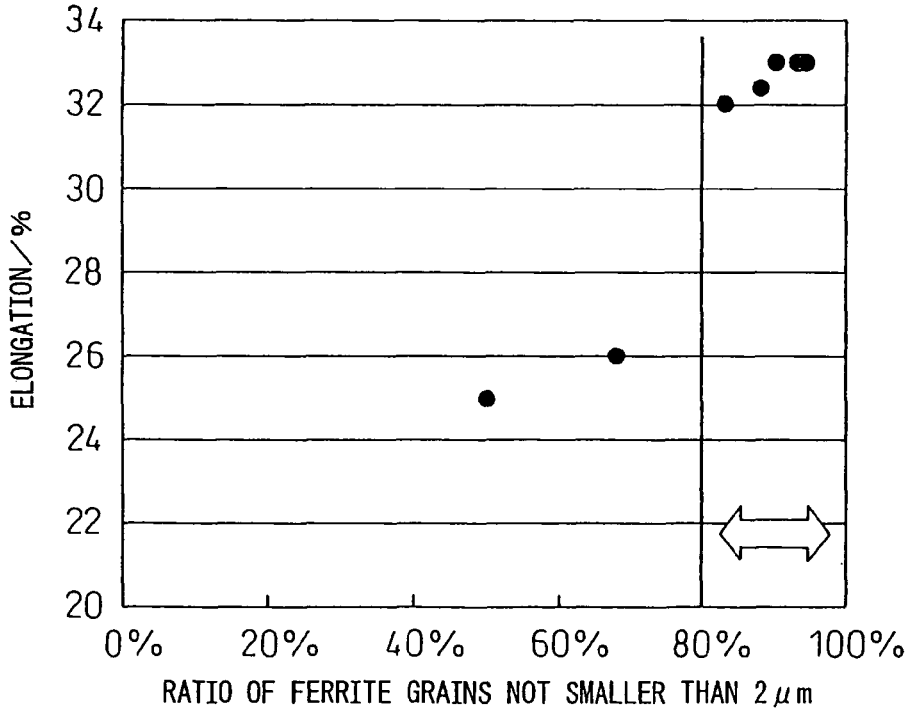
FIG. 6 shows the relationship between ductility and the percentage of ferrite grains not smaller than 2 μm.

Table 10 and FIG. 6 show the relationship between ductility and the ratio of ferrite grains not smaller than 2 μm in all ferrite grains. It is obvious that high ductility is stably obtainable when the ratio is not less than 80%.

Thus, the present invention provides hot-rolled high-strength steel sheets excellent in both hole-expandability and ductility.

TABLE 5

| Steel | C | Si | Mn | P | S | N | Mg | Al | Nb | Ti | Ca | O | Remarks |
|---|---|---|---|---|---|---|---|---|---|---|---|---|---|
| | mass % | | | | | | | | | | | | |
| A | 0.060 | 0.88 | 1.2 | 0.018 | 0.0030 | 0.003 | 0.0030 | 0.040 | 0.000 | 0.025 | — | 0.0015 | Steel of the present invention |
| B | 0.055 | 0.87 | 1.2 | 0.011 | 0.0023 | 0.003 | 0.0040 | 0.028 | 0.000 | 0.020 | — | 0.0007 | Steel of the present invention |
| C | 0.060 | 0.80 | 1.2 | 0.015 | 0.0040 | 0.003 | 0.0020 | 0.005 | 0.000 | 0.020 | — | 0.0015 | Steel of the present invention |
| D | 0.060 | 0.85 | 1.1 | 0.005 | 0.0020 | 0.004 | 0.0040 | 0.002 | 0.000 | 0.025 | — | 0.0015 | Steel of the present invention |
| E | 0.060 | 0.03 | 1.2 | 0.006 | 0.0028 | 0.004 | 0.0023 | 0.180 | 0.000 | 0.025 | — | 0.0010 | Steel of the present invention |
| F | 0.065 | 0.50 | 1.2 | 0.006 | 0.0028 | 0.004 | 0.0023 | 0.200 | 0.000 | 0.025 | — | 0.0010 | Steel of the present invention |
| G | 0.060 | 1.60 | 1.5 | 0.011 | 0.0015 | 0.003 | 0.0030 | 0.042 | 0.000 | 0.020 | — | 0.0015 | Steel of the present invention |
| H | 0.060 | 0.90 | 1.4 | 0.007 | 0.0037 | 0.003 | 0.0035 | 0.032 | 0.000 | 0.020 | — | 0.0015 | Steel of the present invention |
| I | 0.070 | 1.00 | 1.3 | 0.010 | 0.0044 | 0.004 | 0.0017 | 0.032 | 0.000 | 0.030 | — | 0.0008 | Steel of the present invention |
| J | 0.170 | 1.00 | 3.3 | 0.030 | 0.0018 | 0.002 | 0.0035 | 1.300 | 0.000 | 0.025 | — | 0.0015 | Steel of the present invention |
| K | 0.060 | 1.30 | 2.0 | 0.020 | 0.0030 | 0.003 | 0.0035 | 0.034 | 0.000 | 0.025 | — | 0.0015 | Steel of the present invention |
| L | 0.065 | 0.50 | 0.7 | 0.012 | 0.0085 | 0.002 | 0.0080 | 0.030 | 0.000 | 0.035 | — | 0.0007 | Steel of the present invention |
| M | 0.060 | 1.20 | 1.4 | 0.015 | 0.0030 | 0.002 | 0.0050 | 0.005 | 0.000 | 0.190 | — | 0.0040 | Steel of the present invention |
| N | 0.060 | 1.40 | 1.5 | 0.012 | 0.0020 | 0.003 | 0.0010 | 0.800 | 0.000 | 0.020 | — | 0.0007 | Steel of the present invention |
| O | 0.070 | 1.20 | 1.4 | 0.011 | 0.0030 | 0.002 | 0.0025 | 0.030 | 0.000 | 0.020 | 0.002 | 0.0012 | Steel of the present invention |
| P | 0.130 | 0.92 | 1.6 | 0.006 | 0.0035 | 0.004 | 0.0023 | 0.030 | 0.020 | 0.000 | 0.002 | 0.0014 | Steel of the present invention |
| Q | 0.060 | 1.00 | 1.6 | 0.015 | 0.0035 | 0.005 | 0.0017 | 0.037 | 0.010 | 0.010 | — | 0.0010 | Steel of the present invention |
| R | 0.080 | 0.10 | 1.6 | 0.011 | 0.0040 | 0.001 | 0.0029 | 0.450 | 0.000 | 0.025 | 0.002 | 0.0015 | Steel of the present invention |
| S | 0.050 | 0.50 | 1.6 | 0.015 | 0.0030 | 0.002 | 0.0022 | 0.200 | 0.000 | 0.025 | — | 0.0015 | Steel of the present invention |
| T | 0.060 | 0.90 | 1.4 | 0.015 | 0.0030 | 0.002 | 0.0040 | 0.035 | 0.000 | 0.020 | — | 0.0025 | Steel of the present invention |
| U | 0.035 | 0.95 | 1.4 | 0.012 | 0.0030 | 0.002 | 0.0035 | 0.035 | 0.000 | 0.025 | — | 0.0025 | Steel of the present invention |
| V | 0.040 | 1.00 | 1.5 | 0.070 | 0.0030 | 0.002 | 0.0030 | 0.040 | 0.000 | 0.020 | 0.002 | 0.0015 | Steel of the present invention |
| W | 0.060 | 1.00 | 1.2 | 0.008 | 0.0025 | 0.003 | 0.0040 | 0.034 | 0.000 | 0.020 | — | 0.0015 | Steel of the present invention |
| X | 0.060 | 1.20 | 0.8 | 0.017 | 0.0030 | 0.003 | 0.0020 | 0.080 | 0.000 | 0.020 | 0.002 | 0.0015 | Steel of the present invention |
| Y | 0.065 | 0.90 | 1.2 | 0.017 | 0.0030 | 0.002 | 0.0032 | 0.000 | 0.000 | 0.025 | — | 0.0015 | Steel of the present invention |
| Z | 0.060 | 0.90 | 1.9 | 0.016 | 0.0030 | 0.002 | 0.0035 | 0.033 | 0.000 | 0.025 | — | 0.0015 | Steel of the present invention |
| a | 0.210 | 0.80 | 1.4 | 0.120 | 0.0030 | 0.002 | 0.0031 | 0.005 | 0.000 | 0.020 | 0.002 | 0.0015 | Steel for Comparison |
| b | 0.060 | 0.80 | 3.6 | 0.020 | 0.0025 | 0.002 | 0.0040 | 0.030 | 0.000 | 0.020 | — | 0.0015 | Steel for Comparison |
| c | 0.060 | 1.00 | 1.2 | 0.020 | 0.0030 | 0.002 | 0.0030 | 0.035 | 0.000 | 0.020 | — | 0.0060 | Steel for Comparison |
| d | 0.055 | 0.20 | 1.1 | 0.020 | 0.0040 | 0.002 | 0.0029 | 0.030 | 0.000 | 0.020 | — | 0.0015 | Steel for Comparison |
| e | 0.056 | 0.80 | 1.1 | 0.020 | 0.0100 | 0.002 | 0.0040 | 0.030 | 0.000 | 0.020 | — | 0.0015 | Steel for Comparison |
| f | 0.060 | 0.80 | 1.2 | 0.020 | 0.0015 | 0.002 | 0.0003 | 0.030 | 0.000 | 0.020 | 0.002 | 0.0015 | Steel for Comparison |
| g | 0.060 | 0.90 | 1.2 | 0.020 | 0.0040 | 0.002 | 0.0010 | 0.030 | 0.000 | 0.020 | 0.002 | 0.0007 | Steel for Comparison |

TABLE 6

| Steel | Right-hand side of equation 1 | Right-hand side of equation 2 | Right-hand side of equation 3 | Left-hand side of equation 4 | Middle side of equation 8 | Number of precipitates/mm$^2$ | $Ar_3$ ° C. | Remarks |
|---|---|---|---|---|---|---|---|---|
| A | 0.0018 | 0.0054 | 0.0061 | 0.97 | −33 | 3.8E+03 | 815 | Steel of the present invention |
| B | 0.0008 | 0.0081 | 0.0061 | 0.93 | −35 | 4.8E+03 | 816 | Steel of the present invention |

TABLE 6-continued

| Steel | Right-hand side of equation 1 | Right-hand side of equation 2 | Right-hand side of equation 3 | Left-hand side of equation 4 | Middle side of equation 8 | Number of precipitates/mm$^2$ | $Ar_3$ ° C. | Remarks |
|---|---|---|---|---|---|---|---|---|
| C | 0.0018 | 0.0041 | 0.0063 | 0.81 | −47 | 3.3E+03 | 814 | Steel of the present invention |
| D | 0.0018 | 0.0068 | 0.0068 | 0.85 | −33 | 4.3E+03 | 819 | Steel of the present invention |
| E | 0.0012 | 0.0053 | 0.0061 | 0.43 | −89 | 3.2E+03 | 790 | Steel of the present invention |
| F | 0.0012 | 0.0053 | 0.0061 | 0.94 | −36 | 3.2E+03 | 800 | Steel of the present invention |
| G | 0.0018 | 0.0054 | 0.0050 | 1.69 | 17 | 3.0E+03 | 815 | Steel of the present invention |
| H | 0.0018 | 0.0061 | 0.0054 | 0.97 | −49 | 4.6E+03 | 802 | Steel of the present invention |
| I | 0.0010 | 0.0048 | 0.0058 | 1.07 | −32 | 3.5E+03 | 807 | Steel of the present invention |
| J | 0.0018 | 0.0061 | 0.0023 | 3.86 | 43 | 3.7E+03 | 633 | Steel of the present invention |
| K | 0.0018 | 0.0061 | 0.0038 | 1.37 | −64 | 4.3E+03 | 778 | Steel of the present invention |
| L | 0.0008 | 0.0134 | 0.0107 | 0.57 | −27 | 1.2E+04 | 835 | Steel of the present invention |
| M | 0.0048 | 0.0041 | 0.0054 | 1.21 | −24 | 4.5E+03 | 812 | Steel of the present invention |
| N | 0.0008 | 0.0041 | 0.0050 | 3.16 | 173 | 1.7E+03 | 810 | Steel of the present invention |
| O | 0.0014 | 0.0053 | 0.0054 | 1.27 | −21 | 3.4E+03 | 806 | Steel of the present invention |
| P | 0.0017 | 0.0047 | 0.0047 | 0.99 | −87 | 3.4E+03 | 754 | Steel of the present invention |
| Q | 0.0012 | 0.0045 | 0.0047 | 1.08 | −56 | 3.0E+03 | 794 | Steel of the present invention |
| R | 0.0018 | 0.0053 | 0.0047 | 1.09 | −61 | 4.2E+03 | 759 | Steel of the present invention |
| S | 0.0018 | 0.0044 | 0.0047 | 0.94 | −68 | 3.0E+03 | 786 | Steel of the present invention |
| T | 0.0030 | 0.0052 | 0.0054 | 0.98 | −48 | 4.3E+03 | 804 | Steel of the present invention |
| U | 0.0030 | 0.0045 | 0.0054 | 1.03 | −36 | 3.8E+03 | 817 | Steel of the present invention |
| V | 0.0018 | 0.0054 | 0.0050 | 1.09 | −40 | 3.8E+03 | 823 | Steel of the present invention |
| W | 0.0018 | 0.0068 | 0.0063 | 1.07 | −19 | 4.5E+03 | 818 | Steel of the present invention |
| X | 0.0018 | 0.0041 | 0.0094 | 1.38 | 51 | 2.8E+03 | 851 | Steel of the present invention |
| Y | 0.0018 | 0.0057 | 0.0063 | 0.90 | −39 | 4.0E+03 | 815 | Steel of the present invention |
| Z | 0.0018 | 0.0061 | 0.0039 | 0.97 | −96 | 4.3E+03 | 773 | Steel of the present invention |
| a | 0.0018 | 0.0056 | 0.0054 | 0.81 | −111 | 3.9E+03 | 749 | Steel for Comparison |
| b | 0.0018 | 0.0068 | 0.0021 | 0.87 | −269 | 4.5E+03 | 663 | Steel for Comparison |
| c | 0.0072 | −0.0018 | 0.0063 | 1.08 | −19 | 1.5E+03 | 821 | Steel for Comparison |
| d | 0.0018 | 0.0053 | 0.0068 | 0.27 | −93 | 4.2E+03 | 808 | Steel for Comparison |
| e | 0.0018 | 0.0068 | 0.0068 | 0.87 | −30 | 8.3E+03 | 824 | Steel for Comparison |
| f | 0.0018 | 0.0018 | 0.0063 | 0.87 | −41 | 2.0E+02 | 815 | Steel for Comparison |
| g | 0.0008 | 0.0041 | 0.0063 | 0.97 | −31 | 2.5E+02 | 818 | Steel for Comparison |

* Provided, however, that $Ar_3 = 896 - 509\ (C\ \%) + 26.9\ (Si\ \%) - 63.5\ (Mn\ \%) + 229\ (P\ \%)$

TABLE 7

| Steel | Finishing Temperature ° C. | Cooling Rate ° C./s | Air-cooling Start Temperature ° C. | Air-cooling Time s | Coiling Temperature ° C. | Tensile Strength N/mm$^2$ | Elongation % | Hole-Expandability % | Remarks |
|---|---|---|---|---|---|---|---|---|---|
| A1 | 920 | 70 | 680 | 4 | 100 | 608 | 33 | 80 | Steel of the present invention |
| A2 | 910 | 70 | 720 | 2 | 250 | 588 | 31 | 98 | Steel of the present invention |
| A3 | 920 | 40 | — | — | 100 | 618 | 30 | 83 | Steel of the present invention |
| A4 | 930 | 10 | — | — | 100 | 608 | 25 | 50 | Steel for Comparison |
| B1 | 920 | 70 | 670 | 5 | 100 | 603 | 32 | 81 | Steel of the present invention |
| B2 | 900 | 70 | 720 | 2 | 250 | 593 | 31 | 97 | Steel of the present invention |
| B3 | 910 | 70 | 780 | 3 | 100 | 608 | 25 | 74 | Steel for Comparison |
| B4 | 890 | 40 | — | — | 100 | 608 | 31 | 84 | Steel of the present invention |
| C1 | 910 | 70 | 670 | 3 | 100 | 578 | 33 | 85 | Steel of the present invention |
| C2 | 920 | 40 | — | — | 100 | 590 | 31 | 86 | Steel of the present invention |
| D1 | 890 | 70 | 670 | 4 | 100 | 606 | 32 | 84 | Steel of the present invention |
| D2 | 930 | 70 | 680 | 3 | 250 | 591 | 31 | 98 | Steel of the present invention |
| E1 | 930 | 70 | 670 | 3 | 100 | 548 | 34 | 89 | Steel of the present invention |
| E2 | 920 | 40 | — | — | 100 | 558 | 33 | 91 | Steel of the present invention |
| E3 | 920 | 70 | 720 | 3 | 350 | 533 | 25 | 106 | Steel for Comparison |
| F1 | 910 | 70 | 680 | 3 | 100 | 584 | 33 | 84 | Steel of the present invention |
| F2 | 910 | 40 | — | — | 100 | 596 | 31 | 86 | Steel of the present invention |
| F3 | 890 | 70 | 630 | 4 | 100 | 584 | 25 | 55 | Steel for Comparison |
| G1 | 920 | 70 | 680 | 3 | 100 | 791 | 25 | 54 | Steel of the present invention |
| G2 | 920 | 70 | — | — | 100 | 803 | 23 | 56 | Steel of the present invention |
| G3 | 930 | 40 | — | — | 350 | 783 | 20 | 70 | Steel for Comparison |
| H1 | 910 | 70 | 690 | 3 | 100 | 607 | 32 | 81 | Steel of the present invention |
| H2 | 900 | 40 | — | — | 100 | 619 | 30 | 82 | Steel of the present invention |
| I1 | 920 | 70 | 680 | 3 | 100 | 619 | 32 | 79 | Steel of the present invention |
| I2 | 910 | 40 | — | — | 100 | 631 | 30 | 81 | Steel of the present invention |
| J1 | 880 | 70 | 670 | 4 | 100 | 973 | 19 | 29 | Steel of the present invention |
| J2 | 870 | 10 | — | — | 100 | 985 | 13 | 15 | Steel for Comparison |
| K1 | 910 | 70 | 670 | 4 | 100 | 738 | 27 | 65 | Steel of the present invention |
| K2 | 890 | 70 | 680 | 4 | 250 | 723 | 26 | 79 | Steel of the present invention |
| L1 | 890 | 70 | 670 | 3 | 100 | 583 | 33 | 84 | Steel of the present invention |
| L2 | 910 | 40 | — | — | 250 | 568 | 32 | 101 | Steel of the present invention |
| M1 | 890 | 70 | 670 | 3 | 100 | 945 | 20 | 32 | Steel of the present invention |
| M2 | 890 | 50 | 680 | 3 | 100 | 945 | 20 | 32 | Steel of the present invention |

TABLE 7-continued

| Steel | Finishing Temperature ° C. | Cooling Rate ° C./s | Air-cooling Start Temperature ° C. | Air-cooling Time s | Coiling Temperature ° C. | Tensile Strength N/mm$^2$ | Elongation % | Hole-Expandability % | Remarks |
|---|---|---|---|---|---|---|---|---|---|
| N1 | 880 | 70 | 680 | 3 | 100 | 673 | 30 | 71 | Steel of the present invention |
| N2 | 890 | 30 | — | — | 100 | 685 | 27 | 73 | Steel of the present invention |

TABLE 8

(Continued from Table 7)

| Steel | Finishing Temperature ° C. | Cooling Rate ° C./s | Air-cooling Start Temperature ° C. | Air-cooling Time s | Coiling Temperature ° C. | Tensile Strength N/mm$^2$ | Elongation % | Hole-Expandability % | Remarks |
|---|---|---|---|---|---|---|---|---|---|
| 01 | 920 | 70 | 670 | 5 | 100 | 642 | 32 | 70 | Steel of the present invention |
| 02 | 910 | 70 | 690 | 3 | 100 | 642 | 31 | 76 | Steel of the present invention |
| P1 | 890 | 70 | 680 | 3 | 100 | 676 | 30 | 74 | Steel of the present invention |
| P2 | 900 | 70 | 700 | 4 | 100 | 676 | 30 | 72 | Steel of the present invention |
| Q1 | 900 | 70 | 670 | 4 | 100 | 641 | 31 | 73 | Steel of the present invention |
| Q2 | 890 | 150 | 660 | 5 | 100 | 641 | 32 | 72 | Steel of the present invention |
| Q3 | 910 | 40 | — | — | 100 | 653 | 29 | 77 | Steel of the present invention |
| Q4 | 920 | 40 | — | — | 350 | 611 | 23 | 95 | Steel for Comparison |
| R1 | 920 | 70 | 680 | 3 | 100 | 779 | 26 | 53 | Steel of the present invention |
| R2 | 920 | 40 | — | — | 100 | 791 | 24 | 59 | Steel of the present invention |
| S1 | 930 | 100 | 660 | 5 | 100 | 609 | 33 | 77 | Steel of the present invention |
| S2 | 910 | 70 | 720 | 2 | 100 | 609 | 30 | 84 | Steel of the present invention |
| T1 | 900 | 70 | 680 | 3 | 100 | 615 | 32 | 79 | Steel of the present invention |
| T2 | 910 | 40 | — | — | 100 | 627 | 30 | 81 | Steel of the present invention |
| U1 | 890 | 70 | 680 | 4 | 100 | 616 | 32 | 79 | Steel of the present invention |
| U2 | 890 | 40 | — | — | 100 | 628 | 30 | 79 | Steel of the present invention |
| V1 | 890 | 70 | 660 | 3 | 100 | 622 | 32 | 78 | Steel of the present invention |
| V2 | 900 | 70 | 660 | 4 | 250 | 602 | 31 | 96 | Steel of the present invention |
| V3 | 890 | 40 | — | — | 100 | 630 | 30 | 81 | Steel of the present invention |
| W1 | 920 | 70 | 700 | 3 | 100 | 610 | 32 | 80 | Steel of the present invention |
| W2 | 930 | 70 | 660 | 3 | 250 | 590 | 31 | 98 | Steel of the present invention |
| W3 | 910 | 40 | — | — | 100 | 602 | 31 | 87 | Steel of the present invention |
| X1 | 900 | 70 | 690 | 3 | 100 | 582 | 33 | 85 | Steel of the present invention |
| X2 | 930 | 70 | — | — | 100 | 587 | 31 | 84 | Steel of the present invention |
| Y1 | 890 | 70 | 680 | 4 | 100 | 609 | 32 | 81 | Steel of the present invention |
| Y2 | 910 | 70 | 690 | 3 | 250 | 589 | 31 | 98 | Steel of the present invention |
| Z1 | 910 | 70 | 670 | 3 | 100 | 670 | 30 | 71 | Steel of the present invention |
| Z2 | 910 | 70 | 680 | 3 | 250 | 645 | 29 | 90 | Steel of the present invention |
| a1 | 850 | 70 | 680 | 3 | 100 | 683 | 20 | 40 | Steel for Comparison |
| b1 | 900 | 70 | 680 | 4 | 100 | 815 | 18 | 51 | Steel for Comparison |
| c1 | 920 | 70 | 680 | 3 | 100 | 604 | 31 | 40 | Steel for Comparison |
| d1 | 900 | 70 | 670 | 4 | 100 | 523 | 25 | 92 | Steel for Comparison |
| e1 | 900 | 70 | 680 | 3 | 100 | 493 | 34 | 45 | Steel for Comparison |
| f1 | 910 | 70 | 680 | 4 | 100 | 608 | 29 | 50 | Steel for Comparison |
| g1 | 910 | 70 | 680 | 3 | 100 | 516 | 33 | 50 | Steel for Comparison |

TABLE 9

| Steel | Finishing Temperature ° C. | Cooling Rate ° C./s | Cooling Start Temperature ° C. | Air-cooling Time s | Coiling Temperature ° C. | Tensile Strength N/mm$^2$ | Ratio of ds/dl ≧ 0.1 | Elongation % | Hole-Expandability % | Remarks |
|---|---|---|---|---|---|---|---|---|---|---|
| A1 | 920 | 70 | 680 | 4 | 100 | 608 | 91% | 33 | 80 | Steel of the present invention |
| A5 | 920 | 70 | 780 | 4 | 100 | 609 | 40% | 24 | 80 | Steel for Comparison |
| A6 | 920 | 70 | 760 | 4 | 100 | 610 | 70% | 25 | 80 | Steel for Comparison |
| A7 | 920 | 70 | 740 | 4 | 100 | 605 | 82% | 32 | 81 | Steel of the present invention |
| A8 | 920 | 80 | 720 | 4 | 100 | 605 | 88% | 33 | 81 | Steel of the present invention |
| A9 | 920 | 80 | 700 | 4 | 100 | 606 | 90% | 33 | 81 | Steel of the present invention |
| A10 | 920 | 80 | 660 | 4 | 100 | 611 | 92% | 33 | 80 | Steel of the present invention |

TABLE 10

| Steel | Finishing Temperature ° C. | Cooling Rate ° C./s | Cooling Start Temperature ° C. | Air-cooling Time s | Coiling Temperature ° C. | Tensile Strength N/mm$^2$ | Ratio of Ferrite Grains Not Smaller Than 2 μm | Elongation % | Hole-Expandability % | Remarks |
|---|---|---|---|---|---|---|---|---|---|---|
| B1 | 920 | 70 | 670 | 5 | 100 | 603 | 88 | 32 | 81 | Steel of the present invention |
| B5 | 860 | 70 | 670 | 4 | 100 | 603 | 50 | 25 | 81 | Steel for Comparison |
| B6 | 880 | 70 | 670 | 4 | 100 | 601 | 68 | 26 | 81 | Steel for Comparison |
| B7 | 880 | 70 | 730 | 4 | 100 | 600 | 83 | 32 | 81 | Steel of the present invention |
| B8 | 920 | 70 | 730 | 5 | 100 | 603 | 90 | 33 | 81 | Steel of the present invention |
| B9 | 960 | 80 | 670 | 6 | 100 | 605 | 93 | 33 | 81 | Steel of the present invention |
| B10 | 960 | 80 | 730 | 6 | 100 | 605 | 94 | 33 | 81 | Steel of the present invention |

EXAMPLE 3

Example 3 is one of the steels FB according to the present invention.

Steels of compositions and properties shown in Tables 11 and 12 were prepared and continuously cast to slabs by the conventional process. Reference characters A to Z designate the steels whose compositions are according to the present invention, whereas reference characters a, b, c, e and f designate steels whose C, Mn, O, S and Mg contents, respectively, are outside the scope of the present invention.

Steels b, c, d, e and f, respectively, did not satisfy equations (3) and (8), equations (1) and (2), equation (4) and (8), equations (2) and (3), and equation (1). The number of precipitates in steels f and g was outside the scope of the present invention.

The steels were heated in a heating furnace at temperatures not lower than 1200° C. and then hot-rolled to sheets ranging in thickness from 2.6 to 3.2 mm. Tables 13 and 14 show the hot-rolling conditions.

In Tables 13 and 14, the cooling rates of A4 and J2, the air-cooling start temperatures of B3 and F3, and the coiling temperatures of E3, G3 and Q4 are outside the scope of the present invention.

Tensile tests and hole-expanding tests were performed on JIS No. 5 specimens taken from the hot-rolled steel sheets thus obtained. Hole-expandability (λ) was evaluated by expanding a 10 mm diameter punched hole with a 60°-conical punch and using equation $\lambda=(d-dO)/dO\times100$ wherein d=the hole diameter when crack has penetrated through the sheet and dO is the initial hole diameter (10 mm).

Figure 7:
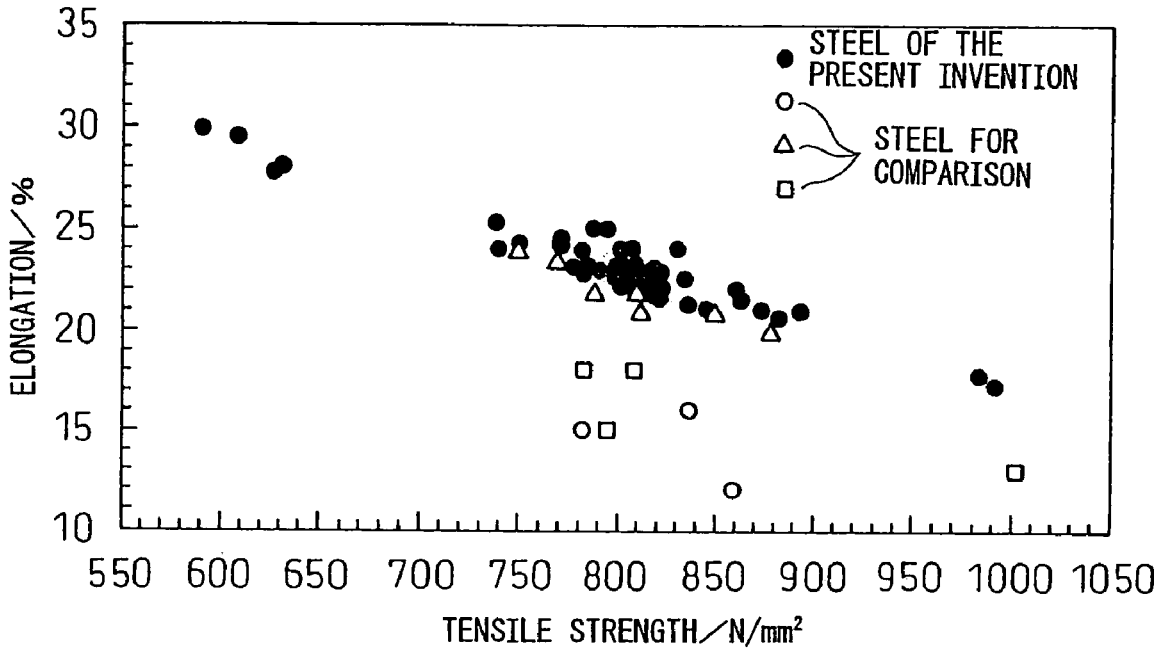
FIG. 7 shows the relationship between tensile strength and ductility.
Figure 8:
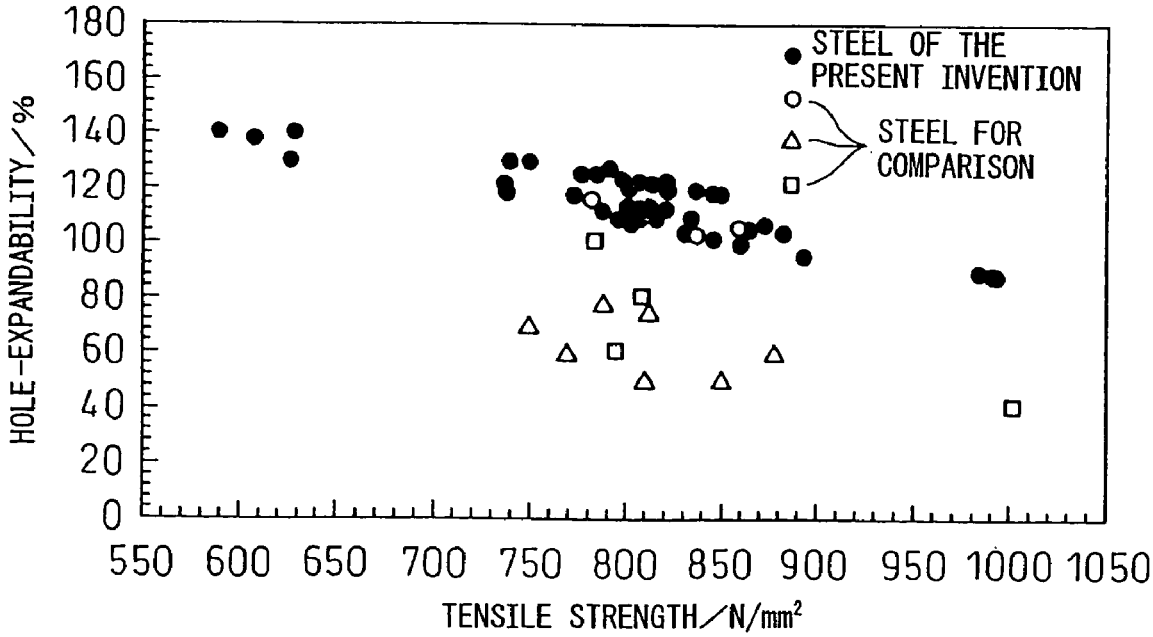
FIG. 8 shows the relationship between tensile strength and hole-expanding ratio.

Tables 13 and 14 show the tensile strength TS, elongation El and hole-expandability λ of the individual specimens. FIG. 7 shows the relationship between strength and ductility and FIG. 8 shows the relationship between strength and hole-expandability (ratio). It is obvious that the steels according to the present invention excel over the steels tested for comparison in either or both of ductility and hole-expandability (ratio).

Figure 9:
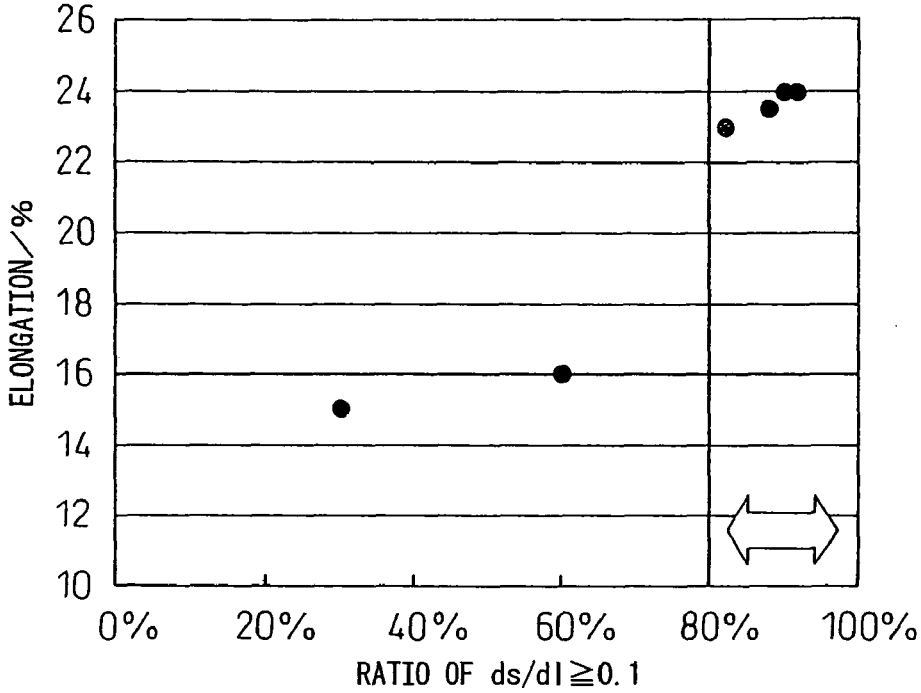
FIG. 9 shows the relationship between ductility and short-diameter to long-diameter ratio (ds/dl).

Table 15 and FIG. 9 show the relationship between ductility and the ratio at which the ratio (ds/dl) of short diameter (ds) to long diameter (dl) exceeds 0.1. It is obvious that high ductility is stably obtainable when the ratio is not less than 80%.

Figure 10:
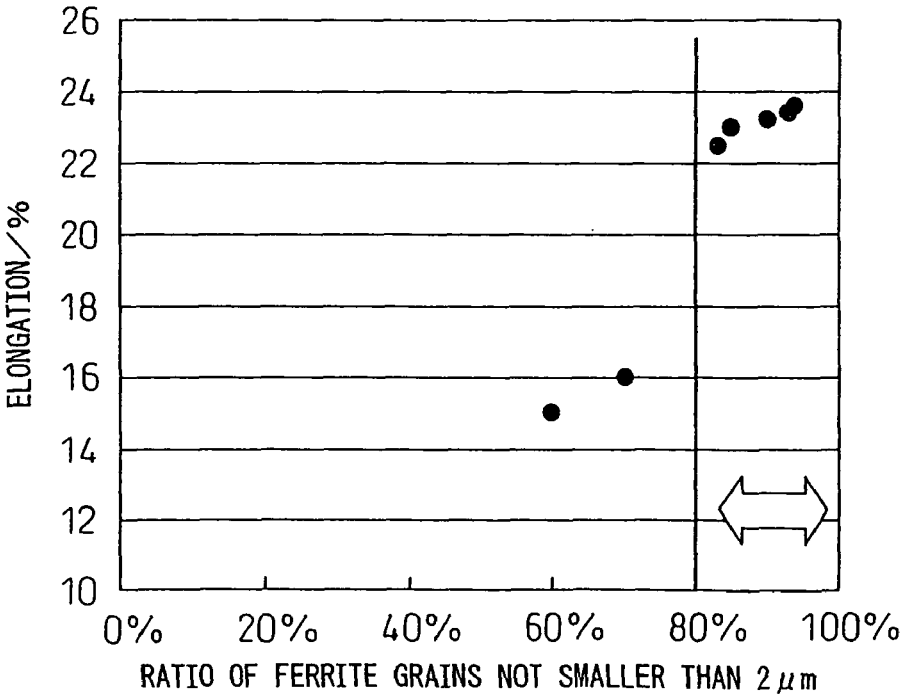
FIG. 10 shows the relationship between ductility and the percentage of ferrite grains not smaller than 2 μm.

Table 16 and FIG. 10 show the relationship between ductility and the ratio of ferrite grains not smaller than 2 μm in all ferrite grains. It is obvious that high ductility is stably obtainable when the ratio is not less than 80%.

Thus, the present invention provides hot-rolled high-strength steel sheets excellent in both hole-expandability and ductility.

TABLE 11

| Steel | C | Si | Mn | P | S | N | Mg | Al | Nb | Ti | Ca | O | Remarks |
|---|---|---|---|---|---|---|---|---|---|---|---|---|---|
| | mass % | | | | | | | | | | | | |
| A | 0.039 | 0.92 | 1.2 | 0.006 | 0.0028 | 0.004 | 0.0023 | 0.030 | 0.037 | 0.124 | — | 0.0014 | Steel of the present invention |
| B | 0.030 | 1.00 | 1.3 | 0.009 | 0.0032 | 0.005 | 0.0017 | 0.037 | 0.022 | 0.152 | — | 0.0010 | Steel of the present invention |
| C | 0.032 | 1.00 | 1.2 | 0.015 | 0.0040 | 0.003 | 0.0020 | 0.005 | 0.028 | 0.150 | — | 0.0015 | Steel of the present invention |
| D | 0.040 | 0.90 | 1.4 | 0.005 | 0.0020 | 0.004 | 0.0040 | 0.002 | 0.042 | 0.140 | — | 0.0015 | Steel of the present invention |
| E | 0.039 | 0.03 | 1.2 | 0.006 | 0.0028 | 0.004 | 0.0023 | 0.180 | 0.037 | 0.124 | — | 0.0010 | Steel of the present invention |
| F | 0.039 | 0.50 | 1.2 | 0.006 | 0.0028 | 0.004 | 0.0023 | 0.200 | 0.037 | 0.124 | — | 0.0010 | Steel of the present invention |
| G | 0.040 | 0.95 | 2.0 | 0.008 | 0.0019 | 0.002 | 0.0044 | 0.036 | 0.036 | 0.081 | — | 0.0011 | Steel of the present invention |
| H | 0.035 | 0.90 | 2.0 | 0.007 | 0.0037 | 0.003 | 0.0035 | 0.033 | 0.032 | 0.083 | — | 0.0015 | Steel of the present invention |
| I | 0.030 | 1.00 | 1.3 | 0.010 | 0.0044 | 0.004 | 0.0017 | 0.032 | 0.028 | 0.160 | — | 0.0008 | Steel of the present invention |
| J | 0.170 | 0.50 | 3.3 | 0.030 | 0.0018 | 0.002 | 0.0035 | 1.300 | 0.035 | 0.100 | 0.003 | 0.0015 | Steel of the present invention |
| K | 0.050 | 1.30 | 2.0 | 0.020 | 0.0030 | 0.003 | 0.0035 | 0.034 | 0.030 | 0.050 | — | 0.0015 | Steel of the present invention |
| L | 0.030 | 0.60 | 0.7 | 0.012 | 0.0085 | 0.003 | 0.0080 | 0.030 | 0.035 | 0.090 | 0.002 | 0.0007 | Steel of the present invention |
| M | 0.060 | 1.20 | 1.4 | 0.015 | 0.0030 | 0.002 | 0.0050 | 0.005 | 0.030 | 0.190 | — | 0.0040 | Steel of the present invention |
| N | 0.050 | 1.40 | 1.5 | 0.012 | 0.0020 | 0.003 | 0.0010 | 0.800 | 0.035 | 0.090 | — | 0.0007 | Steel of the present invention |
| O | 0.040 | 1.20 | 1.4 | 0.011 | 0.0030 | 0.002 | 0.0025 | 0.030 | 0.000 | 0.170 | 0.002 | 0.0012 | Steel of the present invention |
| P | 0.130 | 0.92 | 1.6 | 0.006 | 0.0035 | 0.004 | 0.0023 | 0.030 | 0.037 | 0.124 | 0.002 | 0.0014 | Steel of the present invention |
| Q | 0.030 | 1.00 | 1.6 | 0.009 | 0.0035 | 0.005 | 0.0017 | 0.037 | 0.020 | 0.140 | — | 0.0010 | Steel of the present invention |
| R | 0.039 | 0.10 | 1.6 | 0.006 | 0.0040 | 0.002 | 0.0029 | 0.450 | 0.030 | 0.120 | 0.002 | 0.0015 | Steel of the present invention |
| S | 0.030 | 0.50 | 1.6 | 0.009 | 0.0030 | 0.002 | 0.0022 | 0.200 | 0.035 | 0.120 | — | 0.0015 | Steel of the present invention |
| T | 0.030 | 0.70 | 1.2 | 0.008 | 0.0030 | 0.002 | 0.0040 | 0.035 | 0.015 | 0.060 | 0.002 | 0.0025 | Steel of the present invention |
| U | 0.035 | 0.95 | 1.4 | 0.008 | 0.0030 | 0.002 | 0.0035 | 0.035 | 0.030 | 0.130 | 0.002 | 0.0025 | Steel of the present invention |
| V | 0.040 | 1.00 | 1.5 | 0.070 | 0.0030 | 0.002 | 0.0030 | 0.040 | 0.035 | 0.120 | 0.002 | 0.0015 | Steel of the present invention |
| W | 0.035 | 1.00 | 0.8 | 0.008 | 0.0025 | 0.003 | 0.0040 | 0.034 | 0.015 | 0.080 | — | 0.0015 | Steel of the present invention |
| X | 0.040 | 1.20 | 0.8 | 0.017 | 0.0030 | 0.003 | 0.0020 | 0.080 | 0.030 | 0.100 | 0.002 | 0.0015 | Steel of the present invention |
| Y | 0.030 | 0.90 | 1.2 | 0.017 | 0.0030 | 0.002 | 0.0032 | 0.000 | 0.030 | 0.150 | — | 0.0015 | Steel of the present invention |

TABLE 11-continued

| Steel | C | Si | Mn | P | S | N | Mg | Al | Nb | Ti | Ca | O | Remarks |
|---|---|---|---|---|---|---|---|---|---|---|---|---|---|
| | mass % | | | | | | | | | | | | |
| Z | 0.030 | 0.90 | 1.9 | 0.016 | 0.0030 | 0.002 | 0.0035 | 0.033 | 0.025 | 0.110 | — | 0.0015 | Steel of the present invention |
| a | 0.210 | 1.30 | 1.4 | 0.120 | 0.0030 | 0.002 | 0.0031 | 0.005 | 0.015 | 0.080 | 0.002 | 0.0015 | Steel for Comparison |
| b | 0.040 | 1.00 | 3.6 | 0.020 | 0.0025 | 0.002 | 0.0040 | 0.030 | 0.015 | 0.060 | — | 0.0015 | Steel for Comparison |
| c | 0.030 | 1.00 | 1.5 | 0.020 | 0.0030 | 0.002 | 0.0030 | 0.035 | 0.035 | 0.140 | 0.002 | 0.0060 | Steel for Comparison |
| d | 0.040 | 0.20 | 1.4 | 0.010 | 0.0040 | 0.002 | 0.0029 | 0.030 | 0.030 | 0.150 | 0.002 | 0.0015 | Steel for Comparison |
| e | 0.040 | 1.10 | 1.4 | 0.010 | 0.0100 | 0.002 | 0.0040 | 0.030 | 0.020 | 0.150 | 0.002 | 0.0015 | Steel for Comparison |
| f | 0.035 | 0.90 | 1.4 | 0.010 | 0.0015 | 0.002 | 0.0003 | 0.030 | 0.025 | 0.120 | 0.002 | 0.0015 | Steel for Comparison |
| g | 0.035 | 0.90 | 1.4 | 0.010 | 0.0040 | 0.002 | 0.0010 | 0.030 | 0.030 | 0.140 | 0.002 | 0.0007 | Steel for Comparison |

TABLE 12

| Steel | Right-hand side of equation 1 | Right-hand side of equation 2 | Right-hand side of equation 3 | Left-hand side of equation 4 | Middle side of equation 8 | Number of precipitates/mm$^2$ | $Ar_3$ ° C. | Remarks |
|---|---|---|---|---|---|---|---|---|
| A | 0.0017 | 0.0047 | 0.0061 | 0.99 | −24 | 3.0E+03 | 825 | Steel of the present invention |
| B | 0.0012 | 0.0045 | 0.0058 | 1.08 | −19 | 2.8E+03 | 827 | Steel of the present invention |
| C | 0.0018 | 0.0041 | 0.0063 | 1.01 | −17 | 3.3E+03 | 834 | Steel of the present invention |
| D | 0.0018 | 0.0068 | 0.0056 | 0.90 | −45 | 4.3E+03 | 815 | Steel of the present invention |
| E | 0.0012 | 0.0053 | 0.0061 | 0.43 | −83 | 3.2E+03 | 801 | Steel of the present invention |
| F | 0.0012 | 0.0053 | 0.0061 | 0.94 | −29 | 3.2E+03 | 813 | Steel of the present invention |
| G | 0.0013 | 0.0079 | 0.0038 | 1.03 | −94 | 4.8E+03 | 776 | Steel of the present invention |
| H | 0.0018 | 0.0061 | 0.0038 | 0.97 | −98 | 4.6E+03 | 777 | Steel of the present invention |
| I | 0.0010 | 0.0048 | 0.0058 | 1.07 | −20 | 3.5E+03 | 827 | Steel of the present invention |
| J | 0.0018 | 0.0061 | 0.0023 | 3.36 | −9 | 3.7E+03 | 620 | Steel of the present invention |
| K | 0.0018 | 0.0061 | 0.0038 | 1.37 | −61 | 4.3E+03 | 783 | Steel of the present invention |
| L | 0.0008 | 0.0134 | 0.0107 | 0.67 | −6 | 1.2E+04 | 855 | Steel of the present invention |
| M | 0.0048 | 0.0041 | 0.0054 | 1.21 | −24 | 4.5E+03 | 812 | Steel of the present invention |
| N | 0.0008 | 0.0041 | 0.0050 | 3.16 | 176 | 1.7E+03 | 815 | Steel of the present invention |
| O | 0.0014 | 0.0053 | 0.0054 | 1.27 | −12 | 3.4E+03 | 821 | Steel of the present invention |
| P | 0.0017 | 0.0047 | 0.0047 | 0.99 | −87 | 3.4E+03 | 754 | Steel of the present invention |
| Q | 0.0012 | 0.0045 | 0.0047 | 1.08 | −47 | 3.0E+03 | 808 | Steel of the present invention |
| R | 0.0018 | 0.0053 | 0.0047 | 1.09 | −48 | 4.2E+03 | 779 | Steel of the present invention |
| S | 0.0018 | 0.0044 | 0.0047 | 0.94 | −62 | 3.0E+03 | 795 | Steel of the present invention |
| T | 0.0030 | 0.0052 | 0.0063 | 0.78 | −41 | 4.3E+03 | 825 | Steel of the present invention |
| U | 0.0030 | 0.0045 | 0.0054 | 1.03 | −36 | 3.8E+03 | 816 | Steel of the present invention |
| V | 0.0018 | 0.0054 | 0.0050 | 1.09 | −40 | 3.8E+03 | 823 | Steel of the present invention |
| W | 0.0018 | 0.0068 | 0.0094 | 1.07 | 26 | 4.5E+03 | 856 | Steel of the present invention |
| X | 0.0018 | 0.0041 | 0.0094 | 1.38 | 57 | 2.8E+03 | 861 | Steel of the present invention |
| Y | 0.0018 | 0.0057 | 0.0063 | 0.90 | −29 | 4.0E+03 | 832 | Steel of the present invention |
| Z | 0.0018 | 0.0061 | 0.0039 | 0.97 | −87 | 4.3E+03 | 788 | Steel of the present invention |
| a | 0.0018 | 0.0056 | 0.0054 | 1.31 | −58 | 3.9E+03 | 762 | Steel for Comparison |
| b | 0.0018 | 0.0068 | 0.0021 | 1.07 | −242 | 4.5E+03 | 678 | Steel for Comparison |
| c | 0.0072 | −0.0018 | 0.0050 | 1.08 | −38 | 1.5E+03 | 817 | Steel for Comparison |
| d | 0.0018 | 0.0053 | 0.0054 | 0.27 | −117 | 4.2E+03 | 794 | Steel for Comparison |
| e | 0.0018 | 0.0068 | 0.0054 | 1.17 | −23 | 8.3E+03 | 818 | Steel for Comparison |
| f | 0.0018 | 0.0018 | 0.0054 | 0.97 | −42 | 4.5E+02 | 816 | Steel for Comparison |
| g | 0.0008 | 0.0041 | 0.0054 | 0.97 | −42 | 2.5E+02 | 816 | Steel for Comparison |

* Provided, however, that $Ar_3 = 896 - 509\,(C\,\%) + 26.9\,(Si\,\%) - 63.5\,(Mn\,\%) + 229\,(P\,\%)$

TABLE 13

| Steel | Finishing Temperature ° C. | Cooling Rate ° C./s | Air-cooling Start Temperature ° C. | Air-cooling Time s | Coiling Temperature ° C. | Tensile Strength N/mm$^2$ | Elongation % | Hole-Expandability % | Remarks |
|---|---|---|---|---|---|---|---|---|---|
| A1 | 920 | 70 | 680 | 4 | 490 | 801 | 24 | 112 | Steel of the present invention |
| A2 | 910 | 70 | 720 | 2 | 580 | 846 | 21 | 101 | Steel of the present invention |
| A3 | 920 | 40 | — | — | 500 | 818 | 22 | 120 | Steel of the present invention |
| A4 | 930 | 10 | — | — | 480 | 808 | 18 | 80 | Steel for Comparison |
| B1 | 920 | 70 | 670 | 5 | 490 | 820 | 23 | 110 | Steel of the present invention |
| B2 | 900 | 70 | 720 | 2 | 300 | 795 | 25 | 107 | Steel of the present invention |
| B3 | 910 | 70 | 780 | 3 | 500 | 837 | 16 | 102 | Steel for Comparison |
| B4 | 890 | 40 | — | — | 500 | 849 | 21 | 110 | Steel of the present invention |
| C1 | 910 | 70 | 670 | 3 | 500 | 811 | 23 | 111 | Steel of the present invention |
| C2 | 920 | 40 | — | — | 480 | 813 | 22 | 121 | Steel of the present invention |
| D1 | 890 | 70 | 670 | 4 | 490 | 863 | 21 | 104 | Steel of the present invention |
| D2 | 930 | 70 | 680 | 3 | 550 | 893 | 21 | 94 | Steel of the present invention |
| E1 | 930 | 70 | 670 | 3 | 500 | 738 | 25 | 121 | Steel of the present invention |
| E2 | 920 | 40 | — | — | 480 | 740 | 24 | 128 | Steel of the present invention |
| E3 | 920 | 70 | 720 | 3 | 620 | 810 | 22 | 50 | Steel for Comparison |

TABLE 13-continued

| Steel | Finishing Temperature ° C. | Cooling Rate ° C./s | Air-cooling Start Temperature ° C. | Air-cooling Time s | Coiling Temperature ° C. | Tensile Strength N/mm$^2$ | Elongation % | Hole-Expandability % | Remarks |
|---|---|---|---|---|---|---|---|---|---|
| F1 | 910 | 70 | 680 | 3 | 500 | 771 | 24 | 116 | Steel of the present invention |
| F2 | 910 | 40 | — | — | 500 | 783 | 23 | 124 | Steel of the present invention |
| F3 | 890 | 70 | 630 | 4 | 500 | 783 | 18 | 100 | Steel for Comparison |
| G1 | 920 | 70 | 680 | 3 | 500 | 806 | 23 | 112 | Steel of the present invention |
| G2 | 920 | 70 | — | — | 480 | 808 | 22 | 121 | Steel of the present invention |
| G3 | 930 | 40 | — | — | 620 | 878 | 20 | 60 | Steel for Comparison |
| H1 | 910 | 70 | 690 | 3 | 480 | 772 | 24 | 116 | Steel of the present invention |
| H2 | 900 | 40 | — | — | 480 | 784 | 23 | 124 | Steel of the present invention |
| I1 | 920 | 70 | 680 | 3 | 520 | 834 | 22 | 108 | Steel of the present invention |
| I2 | 910 | 40 | — | — | 500 | 836 | 21 | 118 | Steel of the present invention |
| J1 | 880 | 70 | 670 | 4 | 500 | 990 | 17 | 88 | Steel of the present invention |
| J2 | 870 | 10 | — | — | 500 | 1002 | 13 | 40 | Steel for Comparison |
| K1 | 910 | 70 | 670 | 4 | 450 | 782 | 24 | 124 | Steel of the present invention |
| K2 | 890 | 70 | 680 | 4 | 550 | 802 | 23 | 106 | Steel of the present invention |
| L1 | 890 | 70 | 670 | 3 | 500 | 590 | 30 | 140 | Steel of the present invention |
| L2 | 910 | 40 | — | — | 550 | 627 | 28 | 129 | Steel of the present invention |
| M1 | 890 | 70 | 670 | 3 | 480 | 983 | 18 | 89 | Steel of the present invention |
| M2 | 890 | 50 | 680 | 3 | 500 | 993 | 17 | 87 | Steel of the present invention |
| N1 | 880 | 70 | 680 | 3 | 500 | 810 | 23 | 111 | Steel of the present invention |
| N2 | 890 | 30 | — | — | 500 | 822 | 22 | 120 | Steel of the present invention |

TABLE 14

(Continued from Table 13)

| Steel | Finishing Temperature ° C. | Cooling Rate ° C./s | Air-Cooling start Temperature ° C. | Air-cooling Time s | Coiling Temperature ° C. | Tensile Strength N/mm$^2$ | Elongation % | Hole-Expandability % | Remarks |
|---|---|---|---|---|---|---|---|---|---|
| 01 | 920 | 70 | 670 | 5 | 500 | 830 | 24 | 103 | Steel of the present invention |
| 02 | 910 | 70 | 690 | 3 | 480 | 820 | 23 | 110 | Steel of the present invention |
| P1 | 890 | 70 | 680 | 3 | 480 | 873 | 21 | 106 | Steel of the present invention |
| P2 | 900 | 70 | 700 | 4 | 500 | 883 | 21 | 103 | Steel of the present invention |
| Q1 | 900 | 70 | 670 | 4 | 500 | 817 | 23 | 107 | Steel of the present invention |
| Q2 | 890 | 150 | 660 | 5 | 480 | 807 | 24 | 108 | Steel of the present invention |
| Q3 | 910 | 40 | — | — | 480 | 819 | 22 | 119 | Steel of the present invention |
| Q4 | 920 | 40 | — | — | 200 | 769 | 23 | 60 | Steel for Comparison |
| R1 | 920 | 70 | 680 | 3 | 500 | 738 | 25 | 118 | Steel of the present invention |
| R2 | 920 | 40 | — | — | 500 | 750 | 24 | 128 | Steel of the present invention |
| S1 | 930 | 100 | 660 | 5 | 500 | 787 | 25 | 111 | Steel of the present invention |
| S2 | 910 | 70 | 720 | 2 | 480 | 777 | 23 | 124 | Steel of the present invention |
| T1 | 900 | 70 | 680 | 3 | 480 | 608 | 30 | 138 | Steel of the present invention |
| T2 | 910 | 40 | — | — | 500 | 630 | 28 | 140 | Steel of the present invention |
| U1 | 890 | 70 | 680 | 4 | 480 | 809 | 23 | 111 | Steel of the present invention |
| U2 | 890 | 40 | — | — | 480 | 821 | 22 | 118 | Steel of the present invention |
| V1 | 890 | 70 | 660 | 3 | 520 | 818 | 23 | 110 | Steel of the present invention |
| V2 | 900 | 70 | 660 | 4 | 400 | 798 | 23 | 122 | Steel of the present invention |
| V3 | 890 | 40 | — | — | 550 | 845 | 21 | 117 | Steel of the present invention |
| W1 | 920 | 70 | 700 | 3 | 500 | 820 | 23 | 110 | Steel of the present invention |
| W2 | 930 | 70 | 660 | 3 | 580 | 860 | 22 | 99 | Steel of the present invention |
| W3 | 910 | 40 | — | — | 480 | 822 | 22 | 122 | Steel of the present invention |
| X1 | 900 | 70 | 690 | 3 | 500 | 812 | 23 | 112 | Steel of the present invention |
| X2 | 930 | 70 | — | — | 480 | 802 | 22 | 119 | Steel of the present invention |
| Y1 | 890 | 70 | 680 | 4 | 480 | 821 | 23 | 111 | Steel of the present invention |
| Y2 | 910 | 70 | 690 | 3 | 400 | 811 | 22 | 120 | Steel of the present invention |
| Z1 | 910 | 70 | 670 | 3 | 500 | 801 | 23 | 112 | Steel of the present invention |
| Z2 | 910 | 70 | 680 | 3 | 400 | 791 | 23 | 126 | Steel of the present invention |
| a1 | 850 | 70 | 680 | 3 | 480 | 795 | 15 | 60 | Steel for Comparison |
| b1 | 900 | 70 | 680 | 4 | 480 | 859 | 12 | 105 | Steel for Comparison |
| c1 | 920 | 70 | 680 | 3 | 500 | 850 | 21 | 50 | Steel for Comparison |
| d1 | 900 | 70 | 670 | 4 | 480 | 782 | 15 | 115 | Steel for Comparison |
| e1 | 900 | 70 | 680 | 3 | 480 | 749 | 24 | 70 | Steel for Comparison |
| f1 | 910 | 70 | 680 | 4 | 520 | 788 | 22 | 78 | Steel for Comparison |
| g1 | 910 | 70 | 680 | 3 | 500 | 812 | 21 | 75 | Steel for Comparison |

TABLE 15

| Steel | Finishing Temperature ° C. | Cooling Rate ° C./s | Cooling Start Temperature ° C. | Air-cooling Time s | Coiling Temperature ° C. | Tensile Strength N/mm$^2$ | Ratio of ds/dl ≧ 0.1 | Elongation % | Hole-Expandability % | Remarks |
|---|---|---|---|---|---|---|---|---|---|---|
| A1 | 920 | 70 | 680 | 4 | 490 | 801 | 91% | 24 | 112 | Steel of the present invention |
| A5 | 920 | 70 | 780 | 4 | 490 | 801 | 30% | 15 | 112 | Steel for comparison |
| A6 | 920 | 70 | 760 | 4 | 480 | 796 | 60% | 16 | 113 | Steel for comparison |
| A7 | 920 | 70 | 740 | 4 | 500 | 806 | 82% | 23 | 112 | Steel of the present invention |
| A8 | 920 | 80 | 720 | 4 | 500 | 806 | 88% | 24 | 112 | Steel of the present invention |
| A9 | 920 | 80 | 700 | 4 | 490 | 801 | 90% | 24 | 112 | Steel of the present invention |
| A10 | 920 | 80 | 660 | 4 | 490 | 801 | 92% | 24 | 112 | Steel of the present invention |

TABLE 16

| Steel | Finishing Temperature ° C. | Cooling Rate ° C./s | Cooling Start Temperature ° C. | Air-cooling Time s | Coiling Temperature ° C. | Tensile Strength N/mm$^2$ | Ratio of Ferrite Grains Not Smaller Than 2 μm | Elongation % | Hole-Expandability % | Remarks |
|---|---|---|---|---|---|---|---|---|---|---|
| B1 | 920 | 70 | 670 | 5 | 490 | 820 | 85% | 23 | 110 | Steel of the present invention |
| B5 | 860 | 70 | 670 | 4 | 490 | 820 | 60% | 15 | 110 | Steel for Comparison |
| B6 | 860 | 70 | 700 | 4 | 500 | 825 | 70% | 16 | 109 | Steel for Comparison |
| B7 | 880 | 70 | 730 | 4 | 490 | 820 | 83% | 23 | 110 | Steel of the present invention |
| B8 | 920 | 70 | 730 | 5 | 500 | 825 | 90% | 23 | 109 | Steel of the present invention |
| B9 | 960 | 80 | 670 | 6 | 500 | 825 | 93% | 23 | 109 | Steel of the present invention |
| B10 | 960 | 80 | 730 | 6 | 490 | 820 | 94% | 24 | 110 | Steel of the present invention |

INDUSTRIAL APPLICABILITY

The present invention provides high-strength steel sheets having strength of the order of not lower than 590 N/mm$^2$, or preferably not lower than 980 N/mm$^2$, and an unprecedentedly good balance between ductility and hole-expandability. Therefore, the present invention is of great valve in industries using high-strength steel sheets.

The invention claimed is:

1. High-strength steel sheet excellent in hole-expandability and ductility, consisting of, in mass %, C: not less than 0.01% and not more than 0.20%, Si: not more than 1.5%, Al: from 0.45% to 1.5%, Mn: not less than 0.5% and not more than 3.5%, P: not more than 0.2%, S: not less than 0.0005% and not more than 0.009%, N: not more than 0.009%, Mg: not less than 0.0006% and not more than 0.01%, O: not more than 0.005% and Ti: not less than 0.01% and not more than 0.20% and/or Nb: not less than 0.01% and not more than 0.10%, with the balance being iron and unavoidable impurities, having the Mn %, Mg %, S % and O % satisfying equations (1) to (3), and having the structure primarily comprising of ferrite, and martensite, $$[Mg\%] \geqq ([O\%]/16 \times 0.8) \times 24 \quad (1)$$

$$[S\%] \leqq ([Mg\%]/24 - [O\%]/16 \times 0.8 + 0.00012) \times 32 \quad (2)$$

$$[S\%] \leqq 0.0075/[Mn\%] \quad (3).$$

2. High-strength steel sheet excellent in hole-expandability and ductility described in claim 1, comprising composite precipitates of MgO, MgS and (Nb, Ti)N in the range of 0.05 μm to 3.0 μm in an amount in the range of $5.0 \times 10^2$ to $1.0 \times 10^7$ per square millimeter.

3. High-strength steel sheet excellent in hole-expandability and ductility described in claim 1, characterized by having Al% and Si% satisfying equation (4), $$[Si\%] + 2.2 \times [Al\%] \geqq 0.35 \quad (4).$$

4. High-strength steel sheet excellent in hole-expandability and ductility described in claim 2, characterized by having Al% and Si% satisfying equation (4), $$[Si\%] + 2.2 \times [Al\%] \geqq 0.35 \quad (4).$$

5. High-strength steel sheet excellent in hole-expandability and ductility described in any of claims 1 to 4, characterized by;

having C%, Si%, Al% and Mn% satisfying equation (8), and having a strength exceeding 590 N/mm$^2$ $$-100 \leqq -300[C\%] + 105[Si\%] - 95[Mn\%] + 233[Al\%] \quad (8).$$

6. High-strength steel sheet excellent in hole-expandability and ductility described in claim 5, wherein at least 80% of crystal grains have a short diameter (ds) to long diameter (dl) ratio (ds/dl) of at least 0.1.

7. High-strength steel sheet excellent in hole-expandability and ductility described in claim 6, wherein at least 80% of ferrite crystal grains having a diameter of at least 2 μm.

8. High-strength steel sheet excellent in hole-expandability and ductility described in claim 1, produced by a process having a coiling temperature lower than 300° C.

9. High-strength steel sheet excellent in hole-expandability and ductility described in claim 1, wherein the ferrite content is at least 50%.

* * * * *